US007448802B2

(12) United States Patent
Oettinger et al.

(10) Patent No.: US 7,448,802 B2
(45) **Date of Patent: *Nov. 11, 2008**

(54) INTEGRATED X-RAY SOURCE MODULE

(75) Inventors: Peter E. Oettinger, Acton, MA (US); Frank M. Feda, Sudbury, MA (US); Ruth E. Shefer, Newton, MA (US); Robert E. Klinkowstein, Winchester, MA (US)

(73) Assignees: Newton Scientific, Inc., Cambridge, MA (US); INPHO, Inc., Sudbury, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/763,051

(22) Filed: Jan. 22, 2004

(65) Prior Publication Data

US 2005/0018817 A1 Jan. 27, 2005

Related U.S. Application Data

(63) Continuation-in-part of application No. 10/370,783, filed on Feb. 20, 2003.

(60) Provisional application No. 60/359,169, filed on Feb. 20, 2002.

(51) Int. Cl.
*H01J 35/16* (2006.01)
*H05G 1/10* (2006.01)

(52) U.S. Cl. ..... 378/203; 378/102

(58) Field of Classification Search ..... 378/101, 378/102, 203

See application file for complete search history.

(56) References Cited

U.S. PATENT DOCUMENTS 2,063,329 A * 12/1936 Morrison ..... 378/203
3,075,925 A * 1/1963 Dunegan ..... 252/478
3,643,094 A * 2/1972 Courtois ..... 378/203
4,143,009 A * 3/1979 Dewey ..... 528/74.5
4,504,895 A * 3/1985 Steigerwald ..... 378/105
4,646,338 A 2/1987 Skillicorn ..... 378/110
4,694,480 A 9/1987 Skillicorn ..... 378/119
4,768,215 A 8/1988 Kiwaki et al. ..... 378/101

(Continued)

FOREIGN PATENT DOCUMENTS

GB 2007480 A * 5/1979

(Continued)

OTHER PUBLICATIONS

Search Report for International Application No. PCT/US04/05190.

(Continued)

*Primary Examiner*—Chih-Cheng G Kao
(74) *Attorney, Agent, or Firm*—Chaote, Hall & Stewart LLP

(57) ABSTRACT

Described is a self-contained, small, lightweight, power-efficient and radiation-shielded module that includes a miniature vacuum X-ray tube emitting X-rays of a controlled intensity and defined spectrum. Feedback control circuits are used to monitor and maintain the beam current and voltage. The X-ray tube, high-voltage power supply, and the resonant converter are encapsulated in a solid high-voltage insulating material. The module can be configured into complex geometries and can be powered by commercially available small, compact, low-voltage batteries.

13 Claims, 14 Drawing Sheets

U.S. PATENT DOCUMENTS

| | | | | | |
|---|---|---|---|---|---|
| 4,796,286 | A | | 1/1989 | Ochmann et al. | 378/108 |
| 4,979,198 | A | * | 12/1990 | Malcolm et al. | 378/102 |
| 5,153,900 | A | | 10/1992 | Nomikos et al. | 378/65 |
| 5,517,545 | A | * | 5/1996 | Nakamura et al. | 378/101 |
| 5,631,943 | A | * | 5/1997 | Miles | 378/102 |
| 5,927,482 | A | * | 7/1999 | Davies | 200/305 |
| 6,320,936 | B1 | | 11/2001 | Holland et al. | 378/140 |
| 6,487,273 | B1 | | 11/2002 | Takenaka et al. | 378/142 |
| 6,494,618 | B1 | * | 12/2002 | Moulton | 378/203 |
| 2003/0021377 | A1 | | 1/2003 | Turner et al. | |

FOREIGN PATENT DOCUMENTS

| | | | | |
|---|---|---|---|---|
| JP | 60216298 | A | * | 10/1985 |
| JP | 05031740 | A | * | 2/1993 |
| WO | WO 2004/075610 | | | 9/2004 |
| WO | WO 2004/079752 | | | 9/2004 |

OTHER PUBLICATIONS

TF Series Potted X-Ray tube by Oxford Instruments Inc./X-Ray Technologies, Inc.

TF Series Potted X-Ray tube Line Drawing by Oxford Instruments Inc./X-Ray Technologies, Inc.

Search Report for International Application No. PCT/US04/05190, dated Oct. 13, 2004.

TF Series Potted X-Ray tube by Oxford Instruments Inc./X-Ray Technologies, Inc., Apr. 17, 2000.

TF Series Potted X-Ray tube Line Drawing by Oxford Instruments Inc./X-Ray Technologies, Inc., Apr. 17, 2000.

TF 1000/3000 X-Ray tube, power supply and cable set by Oxford Instruments/X-Ray Technology, Feb. 9, 2003.

Silicone Potted X-Ray Tubes by X-Ray Technologies, Inc., Feb. 9, 2003.

Resin Systems Corporation—High Voltage Electrical Insulators, High Voltage Electrical Bushings and Electrical Feedthrus, Jan. 24, 2003.

40 kV Bullet™ X-Ray Tubes by Moxtek, Nov. 2002.

30 kV Bullet™ X-Ray Tubes by Moxtek, Nov. 2001.

Project Cold Cathode by Oxford Instruments/X-Ray Technology Inc., Apr. 17, 2000.

Field-X Cold Cathode X-Ray Source by Oxford Instruments/X-Ray Technologies, Inc., Nov. 27, 2002.

* cited by examiner

INTEGRATED X-RAY SOURCE MODULE

RELATED APPLICATIONS

This application is a continuation-in-part of U.S. patent application Ser. No. 10/370,783, filed Feb. 20, 2003, which claims priority to U.S. Provisional Patent Application No. 60/359,169, filed Feb. 20, 2002, both of which are incorporated by reference in their entirety herein.

BACKGROUND

1. Technical Field

This application generally relates to X-ray generation equipment, and more particularly to a small, lightweight, and power-efficient X-ray source module.

2. Description of Related Art

Devices including X-ray systems are used in the field for a variety of purposes including, for example, XRF (X-ray fluorescence) analysis of metals, ores, soil, water, paints and other materials, identification of taggant materials for security purposes, and analysis of materials in bore holes. Until recently, field-portable XRF instruments used radioactive sources, such as Cd-109, to provide the required X-ray flux. However, the intensity of a radioactive source decays with time requiring frequent recalibration, and radioactive sources are subject to strict regulatory control with respect to transportation, storage and disposal. Moreover, a radioactive source cannot be turned off when not in use, further exacerbating the safety issues associated with such a source.

As an alternative to the radioactive source, the devices may include X-ray systems that use an electronic X-ray source for XRF and other X-ray analytical applications. X-ray sources that operate at power levels of 5 watts or less at voltages in the range of approximately 5-100 kV are known to fulfill the intensity and spectral requirements for most field-portable X-ray instruments. For practical considerations, it may be desirable to have a field-portable X-ray source that is small and lightweight, fits into an ergonomic hand-held enclosure, is powered from a lightweight battery such as a dry cell, and incorporates radiation shielding to prevent stray radiation from the X-ray tube from reaching the operator. Furthermore, it may be desirable to have the X-ray source voltage and current be highly regulated, (e.g., such as better than a 0.1% variation), to provide a stable X-ray beam of predetermined intensity. It may also be desirable to have a device such that the operating parameters of the device can be externally controllable by other electronic circuits contained within the instrument. Conventional X-ray tubes and their associated electronics are typically designed to operate at much higher power levels of 50 watts and above. They are too bulky, too heavy, and require too much electrical power for field-portable applications. Therefore, there is a need for a high accuracy and stability, low-power, lightweight, compact, radiation shielded X-ray source for use in XRF instruments and other portable and hand-held X-ray analytic instruments.

Radiation shielding of a hand-held X-ray generating device is particularly difficult. X-ray shielding usually takes the form of a layer of high atomic number, high density material, such as lead, tungsten, or molybdenum surrounding the X-ray source. Since an X-ray tube operating at 5-100 kV emits X-rays uniformly in all directions from the electron beam focal spot on the X-ray target, emission in directions other than along the desired X-ray beam direction must be shielded. In practice, some shielding is provided by the walls of the X-ray tube itself, and by the coolant fluid (if any) and electrically insulating material that surrounds the X-ray tube, but this is usually not sufficient to prevent exposure of personnel in close proximity to the tube. In order to minimize the total mass of shielding material, it may be desirable to have the shielding material mounted as close to the source of X-rays as possible. However, this is usually not possible in practice due to the presence of the coolant fluid and electrical insulation mentioned above. Furthermore, if shielding is provided by an external housing formed from radio-opaque material, extreme care must be taken to eliminate any cracks or seams in the housing. Satisfactory shielding is typically accomplished by providing a region of overlap at every seam, further increasing the total weight of the shielding material. Extreme care must also be taken to ensure that the shielding material cannot shift relative to the source of X-rays. This is particularly important in a portable unit that may be subject to large mechanical and thermal stresses in the field.

Thus, it may be desirable to have a low-power X-ray system that may be used for field applications which overcomes the drawbacks of existing systems.

SUMMARY OF THE INVENTION

In accordance with one aspect of the invention is a system that generates X-rays. An X-ray tube emits X-rays. Electron beam current control electronics controls an electron beam current of said X-ray tube using a first feedback signal based on a measure of an electron beam current of the X-ray tube. High voltage control electronics controls a high voltage power supply using a second feedback signal based on voltage sensing, wherein a resonant converter drives said high voltage power supply and a beam current sense resistor is connected to an anode of the X-ray tube and said beam current sense resistor to generate said first feedback signal.

In accordance with another aspect of the invention is a system that generates X-rays. An X-ray tube emits X-rays. A high voltage power supply coupled to said X-ray tube supplies a high voltage for use with said X-ray tube and is driven by a resonant converter. The X-ray tube includes a filament. A control circuit controls said high voltage power supply and is responsive to a voltage feedback signal.

In accordance with yet another aspect of the invention is a radiation-shielded X-ray module. An X-ray tube emits X-rays. A high voltage power supply coupled to said X-ray tube supplies a high voltage for use with said X-ray tube. An electrical connection connects the X-ray tube to the high voltage power supply, wherein the X-ray tube, the high voltage power supply and the electrical connection are encapsulated in a solid, electrically-insulating material containing a radio-opaque material.

In accordance with still another aspect of the invention is an X-ray module that includes an X-ray tube, a resonant converter, a high voltage power supply driven by the resonant converter, and an electrical connection that connects the X-ray tube to the high voltage power supply and connects the high voltage power supply to the resonant converter. The X-ray tube, high voltage power supply and electrical connection connecting the X-ray tube to the high voltage power supply are encapsulated in a solid, electrically-insulating material.

In accordance with another aspect of the invention is an X-ray module including an X-ray tube that includes a filament and emits X-rays, a resonant converter, a high-voltage power supply driven by said resonant converter, low-voltage control electronics; and an electrical connection that connects the X-ray tube to the high voltage power supply, connects the low-voltage control electronics to the resonant converter and connects the resonant converter to the high-voltage power supply.

In accordance with yet another aspect of the invention is a method of producing an X-ray module including: encapsulating electronic components used in X-ray emission in a solid cast block including a radio-opaque material; and surrounding said solid cast block by a conductive layer.

In accordance with another aspect of the invention is control electronics used in an X-ray emitter. Electron beam current control electronics controls an electron beam current using a first feedback signal based on current sensing of an emitted beam current. A beam current sense resistor is connected to an anode of an X-ray tube. The beam current sense resistor is used to generate said first feedback signal. High voltage control electronics controls a high voltage power supply using a second feedback signal based on voltage sensing, wherein a resonant converter drives said high voltage power supply.

In accordance with another aspect of the invention is a method for controlling electron beam current and voltage of an X-ray emitting device drive by a high voltage power supply including: producing a first feedback signal used in electron beam current control electronics that controls an electron beam current, said first feedback signal being based on current sensing of an emitted beam current, wherein said first feedback signal is generated using a beam current sense resistor connected to an anode of an X-ray tube; and producing a second feedback signal used in high voltage control electronics that controls a high voltage power supply, said second feedback signal being based on voltage sensing, wherein a resonant converter drives said high voltage power supply.

In accordance with yet another aspect of the invention is a radiation-shielded X-ray module including: an X-ray tube that emits X-rays, a high voltage power supply coupled to said X-ray tube that supplies a high voltage for use with said X-ray tube, and an electrical connection that connects the X-ray tube to the high voltage power supply. The X-ray tube is encapsulated in a solid, electrically-insulating material containing a radio-opaque material.

BRIEF DESCRIPTION OF THE DRAWINGS

Features and advantages of the present invention will become more apparent from the following detailed description of exemplary embodiments thereof taken in conjunction with the accompanying drawings in which.

DETAILED DESCRIPTION OF EMBODIMENT(S)

Figure 1A:
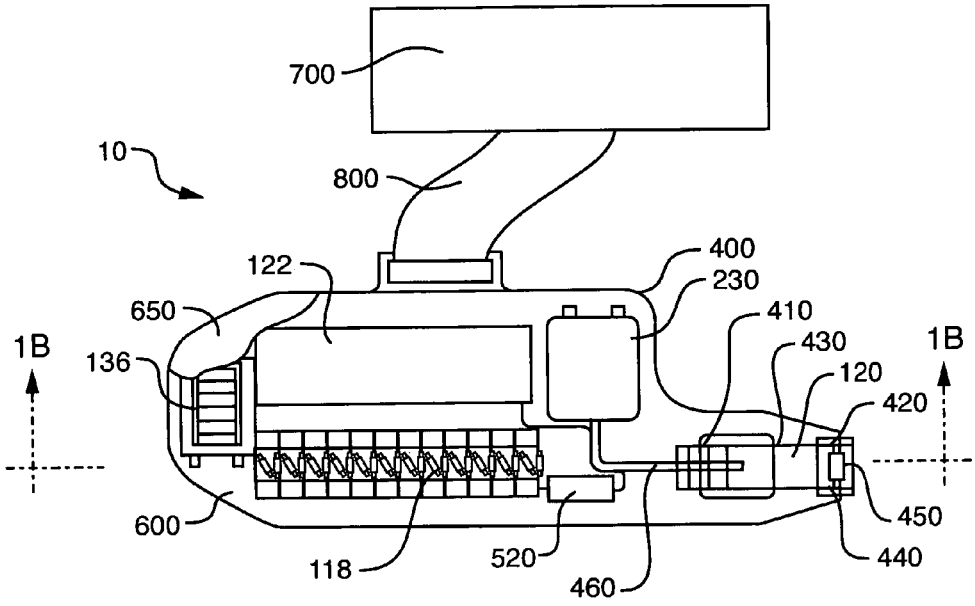
FIG. 1A is an example of an embodiment of a system including a modular X-ray source showing a longitudinal section of the encapsulated high voltage unit containing the X-ray tube and high voltage electronics, and the low voltage power and control circuit connected to the modular unit via an electrical cable.

Referring now to FIG. 1A, shown is an example of an embodiment 10 of a modular unit 400 connected by a cable 800 to a printed circuit board (PCB) 700. Details of the PCB 700 and modular unit 400 are described in more detail in following paragraphs. The modular unit 400 is encased in an electrically insulating potting material 600 and surrounded by a grounded conducting surface 650. The unit 400 is powered by a low voltage power and control circuit on PCB 700 that obtains electrical power from a standard storage battery included thereon. It should be noted that other embodiments may include a battery in an arrangement in which the battery is not located on the PCB 700. The low voltage circuit included on PCB 700 may be located external to the high voltage module unit or modular unit 400, or it may be located within the insulating potting material. In either case, the low voltage circuit is connected to the module via an electrical cable or by another suitable board-to-board connector.

It should be noted that embodiment of FIG. 1A depicts a system 10 that is drawn approximately to scale that may be used, for example, in applications for hand-held instruments. Other embodiments may use other sizes for the system 10 in accordance with a particular application and device.

The modular unit 400 is encapsulated in a rigid, non-conducting, high-dielectric-strength material 600 such as epoxy, and the grounded conducting surface 650 in this embodiment is a thin-layer or coating adherent to the outer surface of the rigid encapsulating material 600.

FIG. 1A shows the encapsulated unit 400 and separate low voltage power and control circuit on a PCB 700 in accordance with one embodiment. The unit 400 comprises a miniature low-power X-ray tube 120, a high voltage power supply component 118, a voltage sensing resistor 122 and a filament transformer 230. The unit 400 is designed to be used in conjunction with a low voltage power and control circuit that may be included on PCB 700 that obtains electrical power from a standard storage battery.

In FIG. 1A, the low voltage power and control circuit may be mounted on a single printed circuit board 700, connected to the unit 400 by a thin, flexible low voltage cable 800. This configuration may reduce overall size and provide greater flexibility in integrating the invention into certain existing and new applications. Alternately, any or all parts of the low voltage power and control circuit can be contained within the encapsulated unit 400. Moreover, a mechanical interface may be incorporated into the foregoing to permit attachment of accessories to the front of the X-ray tube window, or attachment of the foregoing device, or one of its components, to an external structure. This interface can take the form, for example, of a series of threaded holes or other mechanical-locating features, including flanges and tabs.

The components of the unit 400 are encapsulated within a solid, cast block 600 made from a non-conducting, high dielectric strength material. The block 600 may be cast from epoxy, urethane, or silicone potting compound. In one embodiment, the block is cast from a rigid, two-part epoxy resin casting system, such as Emerson & Cuming Stycast 2850FT, which is rigid when cured. Alternately, the block may be cast from a semi-rigid urethane material, such as Product No. 200/65 from P. D. George Co. (St. Louis, Mo.). Resin casting techniques known in the art may be employed to ensure that the cast material is free from entrained air, since air pockets create regions of enhanced electric field which can lead to high voltage breakdown. These techniques may include vacuum degassing of the casting material prior to use, and curing under pressure. The high voltage block is surrounded by a thin conductive layer typically 1 mil to 2 mil in thickness, for example, to shield the electric fields produced by the X-ray tube and associated electronics.

The thin conductive layer 650 is preferably applied directly to the outer surface of the high voltage block. The layer may be formed of a conducting metallic paint, such as Super Shield Conductive Nickel Coating (MG Chemicals, Toronto, Canada), or of a thin metal foil (e.g. 1-2 mil thick of aluminum or copper foil) or metallized polymer (e.g aluminized Mylar). If a thin foil is used, it may be made to adhere directly to the high voltage block with a suitable adhesive. The conductive layer is typically held at essentially ground potential relative to the high voltage power supply and other electronics in the X-ray instrument. This may be accomplished, for example, by providing a ground pad on the encapsulated unit that is electrically connected to the high voltage power supply and is covered by the conductive coating when the coating is applied.

The X-ray tube 120 shown in FIG. 1A is an end-window tube located at the distal end of the narrow neck extending from the main portion of the block. Even when space is limited, this geometry allows the output window 450 of the X-ray tube to be placed in close proximity to the region to be irradiated, thereby providing the highest possible X-ray intensity at that location. The neck is shown oriented at an angle to the rest of the high voltage module.

It will be appreciated that the geometry shown is only exemplary, and that the high voltage module 400 can easily be fabricated in a wide variety of geometrical arrangements, as dictated by the requirements of a particular application. For example, some applications may benefit from an X-ray tube with a side-looking window, while others may benefit from a curved neck. In fact, the encapsulation material can be cast into virtually any geometry that is compatible with the electrical function of the internal components. Resin casting techniques are well-known in the art. In the example shown, the X-ray tube 120 uses a hot-filament electron emitter that receives electrical power from the filament transformer 230. Other electron emitters may also be used, for example, such as cold cathode emitters that do not require a filament transformer.

The connection between the secondary of the filament transformer and the filament of the X-ray tube is made using a coaxial cable in order to minimize electrical noise generated by the filament drive circuit. FIG. 1A shows the X-ray tube connected to the high voltage generator and filament transformer by a rigid coaxial cable 460 in which the space between the inner and outer conductors is filled with the electrically-insulating encapsulation material. Alternately, a commercially-available flexible coaxial cable could be used. In FIG. 1A, the high voltage terminal of the high voltage power supply component 118 is shown connected to the outer conductor of the coaxial cable, and the outer conductor is in turn connected to the cathode end 410 of the X-ray tube. Alternately, the connection between the high voltage generator and the cathode of the X-ray tube can be made via the inner conductor of the coaxial cable. The secondary of the filament transformer is connected across the filament leads of the X-ray tube. In this configuration, the current supply and return conductors of the filament drive circuit are coaxial, thereby minimizing the electrical power radiated by the circuit connected to the secondary of the filament transformer. Since the filament circuit typically carries the highest current in a low power X-ray module, it is especially important to minimize electrical noise produced by the filament circuit. This is particularly important in a compact hand-held unit in which noise-sensitive X-ray detection circuitry may be placed in close proximity to the X-ray tube.

The high voltage power supply component 118, the voltage sensing resistor 122 and the filament transformer 230 (if required) of FIG. 1A are preferably positioned in the module so that the regions at high voltage are in close proximity to one another. Likewise, the high voltage end of the X-ray tube is preferably positioned as close as possible to the other components at high voltage, while remaining within the constraints of the geometry of the X-ray instrument. The shape of the surrounding encapsulation material is chosen so as to provide sufficient electrical insulation between the power supply components and the grounded conductive coating. Thus, internal components that reach high voltages during operation may be surrounded by a larger thickness of encapsulating material than components that normally operate at lower voltages.

The maximum thickness of encapsulating material is determined by the maximum rated operating voltage of the unit with an additional safety factor to account for electric field enhancements at the surfaces of the internal components. For example, for a module operating at a maximum voltage of 40 kV, high voltage insulation is achieved using 0.25 inches or less of a cast epoxy material with a nominal dielectric strength of 625 V/mil.

The high voltage power supply component 118 may be, for example, a Cockroft-Walton-type voltage multiplier, as is well known in the art. Other power supply configurations are also possible, including, for example, symmetrical cascade voltage multipliers, and step-up transformers. The multiplier in this embodiment which serves as the power supply component 118 is a 12 stage series-fed multiplier operating at a frequency of approximately 70 kHz and driven by a step-up transformer 136 with a turns ratio of 125:1. For a terminal voltage of 35 kV, the voltage per stage is approximately 2.9 kV. The output of the high voltage multiplier 118 is connected to the X-ray tube 120 through a 10 kOhm current limiting resistor 520. The voltage sensing resistor 122 is a precision voltage divider with divider ratio of approximately 10,000:1 and a total resistance of 1-10 Gigohms.

The filament transformer 230 in this embodiment includes a primary winding, a secondary winding, and magnetic core. As known in the art, the turns ratio, defined as the number of secondary winding turns divided by the number of primary winding turns, may be adjusted to match the voltage and current range of the filament to the drive circuitry. The magnetic core may be "U" shaped, toroidal, bobbin or other commonly used magnetic core geometries. The core material is preferably ferrite, but may be another material such as, for example, silicon steel, powdered iron, or metglass. In the embodiment described herein, the filament transformer uses a toroidal ferrite core, such as Magnetics part number 41809-TC, and is configured as a step-down transformer having 32 primary turns, and 5 secondary turns.

The X-ray tube 120 of the embodiment of FIG. 1A is preferably a metal-ceramic, end-window X-ray tube operating with the anode at ground potential. Referring back to FIG. 1A, the X-ray tube 120 includes a cathode end 410 and an anode end 420, separated by a ceramic insulator 430. To meet the requirements for use in a hand-held XRF instrument, the X-ray tube operates at an electron beam current of up to 50-100 microamperes at a maximum operating voltage of 35-40 kV. X-ray tubes with these parameters are available in suitably small sizes from several commercial suppliers. For example, Moxtek (Orem, Utah) manufactures a metal-ceramic, end-window, transmission target X-ray tube with approximate dimensions 1×0.38 inch. Newton Scientific Inc. (Cambridge, Mass.) manufactures a metal-ceramic, end-window X-ray tube with similar operating parameters and approximate dimensions 1.5×0.34 inch. X-Ray and Specialty Instruments Inc. (Ypsilanti, Mich.) also manufactures a similar X-ray tube with dimensions 1.5×0.25 inch.

The aforementioned tubes are configured as an evacuated, sealed ceramic tube terminated at one end by an electron emitter (cathode) assembly designed to operate at high voltage and at the other end by an X-ray transmission target comprising a beryllium X-ray window coated on the electron beam side with a thin layer of X-ray target material. Commercially available target materials include Ag, Pd, W, and others. The end-window, grounded anode configuration is preferable because it allows the X-ray target and electron beam focal spot to be located close to the outer surface of the X-ray module, as illustrated in FIG. 1A, thereby maximizing the available X-ray intensity for a given tube current and voltage.

Small X-ray tubes with the appropriate operating parameters and side-looking X-ray windows are also available, and may be preferred in some applications. An example is the TF 1000/3000 Series X-ray Tube from OxfordTRG, (Scotts Valley, Calif.). All of the aforementioned X-ray tubes use hot tungsten filament electron emitters that operate at power levels of less than 5 watts. A small cold cathode X-ray tube has also been developed by OxfordTRG, and is available in a configuration suitable for use in the X-ray module of the present invention. In an embodiment including the cold cathode, components of FIG. 1A, such as the filament transformer 230, may be omitted since electrical power is not needed.

Radiation shielding is provided in the embodiment of FIG. 1A by adding an electrically insulating, radio-opaque filler material to the encapsulating material of the high voltage block 600. It should be noted that any one or more of techniques known in the art may be used to mix filler materials into the potting compounds. Examples of such filler materials are compounds (e.g., oxides or carbonates) of tungsten, lead, calcium, tantalum, tin, molybdenum, copper, strontium, or bismuth, or non-compounded forms of these elements. Materials containing high atomic number elements, such as lead oxide, tungsten oxide, or bismuth oxide, are preferred when a high degree of attenuation is to be provided by a relatively small thickness of filled epoxy. The amount of radio-opaque material required for a particular application depends on the photon energy spectrum of the X-ray source and on the degree of radiation attenuation desired. It is well known that an X-ray source of the type described above emits a continuum (or bremsstrahlung) photon spectrum with a maximum energy equal to the product of the maximum voltage and the electron charge. Hence, an X-ray source operating at a voltage of 35 kV will emit a broad spectrum with an end-point photon energy of 35 keV. It can be shown by straightforward calculation that a thickness of 0.5 mm of lead will provide an attenuation factor of approximately $10^7$ for such an X-ray source. It can also be shown by straightforward calculation that an equivalent degree of attenuation can be provided by a layer 0.25 inches thick of lead-oxide filled epoxy incorporating approximately 11% by volume of lead oxide. For example, a standard epoxy resin such as Emerson & Cuming Stycast 2850 FT, can be mixed with 1-2 micrometer particle size lead oxide powder to achieve the required attenuation factor.

A commercially available lead oxide filled epoxy such as RS-2232 Lead Oxide Filled Epoxy Resin from Resin Systems, Amherst, N.H., can also be used. Alternately, a resin filled with compounds (e.g., oxides or carbonates) of tungsten, lead, calcium, tantalum, tin, molybdenum, copper, strontium, bismuth, or a combination of any of the above, can be used in the foregoing embodiment. These elements may also be used in their pure form, as long as the filled resin is still substantially nonconductive. It is well known that high atomic number elements and their compounds are effective absorbers of X-ray radiation. Thus, other high atomic number elements and their compounds may also be used, alone or in combination with the materials listed above.

As shown in FIG. 1A, the radio-opaque filled epoxy 600 completely surrounds the X-ray tube 120, with the exception of the X-ray output window 450. The radio-opaque epoxy 600 provides electrical insulation between the high voltage cathode end 410 of the X-ray tube and the electrically grounded conductive coating 650. The radio-opaque epoxy 600 also provides electrical insulation along the surface of the ceramic high voltage insulator 430 of the X-ray tube. Thus, the radio-opaque epoxy 600 is in intimate contact with the entire outer surface of the X-ray tube, thereby providing the lightest weight configuration for a given desired radiation attenuation factor. In some applications, it may be advantageous to reduce the thickness of the epoxy near the X-ray output window to permit placement of the output window close to the material to be irradiated. In such cases, additional radiation shielding may be provided by a hollow cylinder 440 of high atomic number material, such as tungsten, positioned around the anode end of the X-ray tube, as illustrated in FIG. 1A.

Figure 1B:
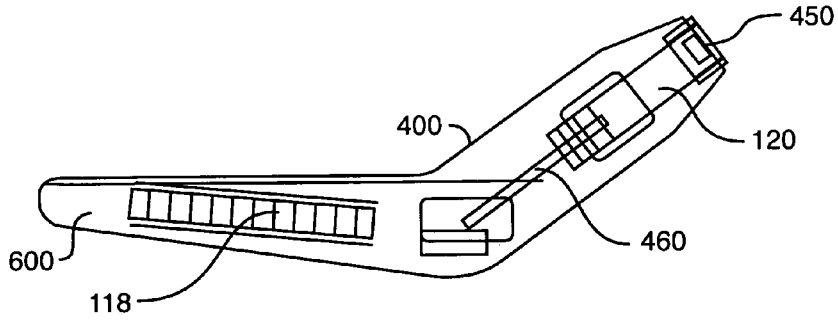
FIG. 1B shows a side view of the embodiment of FIG. 1A according to the system described herein.

Referring now to FIG. 1B, shown is a side profile view of the unit 400 shown in FIG. 1A.

Figure 1C:
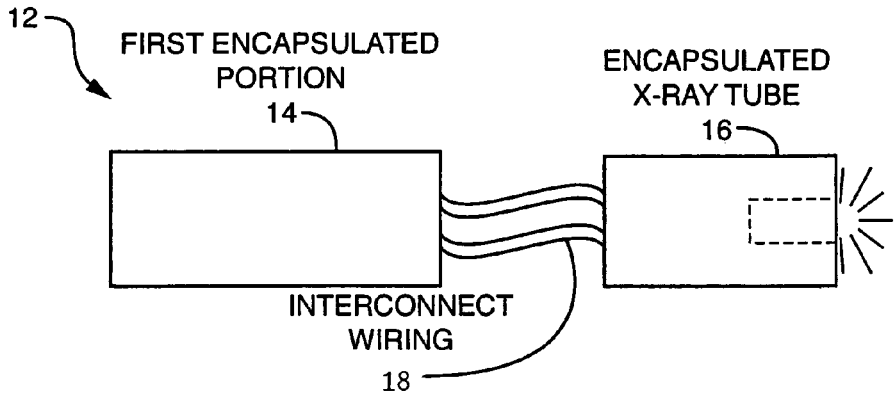
FIG. 1C is an example of another embodiment of a system including a modular X-ray source.

Referring now to FIG. 1C, shown is an example of another embodiment 12 of a system including a modular X-ray source. The embodiment 12 includes a first encapsulated portion 14 and an encapsulated X-ray portion 16 electrically connected using interconnect wiring 18. In this embodiment, the interconnect wiring 18 may be, for example, a coaxial cable although other embodiments may use other types of connections between one or more portions for electrical connectivity as needed. The X-ray tube is encapsulated in the portion 16 separately in a solid encapsulation material, and is connected to the first encapsulated portion 14 which, in this example, includes the high voltage power supply and filament transformer. As in the previous embodiment described herein, in the embodiment of FIG. 1C, the encapsulation material 600 may surround any or all parts of the X-ray tube, except the X-ray output window. The encapsulation material may contain a radio-opaque material, thereby providing effective radiation shielding of the output of the X-ray tube in all directions other than the direction defined by the X-ray output window. The electrical connection between the X-ray tube and the high voltage power supply and filament transformer may be made using a flexible or rigid electrical cable. In order to provide maximum shielding from electrical noise, the cable may be preferably a coaxial cable. In this embodiment of FIG. 1C, the conductive coating 650 surrounds the encapsulated X-ray tube unit and is electrically connected to the ground of the high voltage power supply via the electrical cable.

The foregoing embodiment 12 may have advantages in some applications in which the X-ray tube is placed in a part of an X-ray instrument in which space is very restricted. It should be appreciated that other arrangements of the electrical components of the X-ray module are also possible and may be preferred in certain applications depending on the exact configuration of the X-ray instrument in which the inventive X-ray unit is incorporated. For example, the filament transformer may be encapsulated together with the X-ray tube, and the unit containing the X-ray tube and filament transformer connected to the high voltage power supply with an electrical cable.

An embodiment may also include more than two separate groupings of components of the system or device and may also include a different grouping of components than as described herein. Additionally, although the embodiments described herein as 10 and 12 include groupings of components in encapsulated portions, one or more of the groupings may omit encapsulation in accordance with the particulars of each implementation and applications. For example, referring back to FIG. 1C, an embodiment may have only one of portions 14 or 16 encapsulated rather than both.

In an embodiment, one or more groupings may be encapsulated but not all groupings may include the radio-opaque material. For example, in the embodiment of FIG. 1C, the first encapsulated portion 14 may be cast in encapsulating material that does not include radio-opaque material, and the X-ray tube may be cast in encapsulating material that includes radio-opaque material. In this way the radio-opaque material is used to shield the X-ray emitter, where it is needed most, whereas the first encapsulated portion is rendered lighter in weight by not including the radio-opaque material.

Referring now to FIGS. 2A, 2B, 2C and 2D, shown are different views of another embodiment according to the system described herein. In an alternate embodiment as shown in FIGS. 2A-2D, the unit 400 is encapsulated in a semi-rigid material such as urethane or silicone, and enclosed within a separate, rigid lightweight conducting housing 900.

It should be noted that in an embodiment, the encapsulating material 600 may contain radiation shielding material to shield X-rays emanating from the unit in directions other than the desired X-ray beam direction.

In connection with the circuitry included on the PCB 700 in order to reduce power consumption (an important consideration in battery-powered portable applications), a high-efficiency power supply and high precision, high accuracy control circuitry is described herein for generating and controlling the high voltage necessary to accelerate the X-ray tube electron beam and for creating an electron beam by thermionic emission from a heated filament.

As described in following paragraphs, high voltage output is under closed-loop control and established through an input control signal. A negative voltage is used to permit operation of the tube in a grounded anode configuration, which may be desirable in certain applications. The power supply can also provide positive high voltage output, in which the cathode is at ground potential. The beam current circuit may be used to generate and control the electron beam current in the X-ray tube. The beam current is under closed-loop control with a magnitude established through a beam current input control signal. Although, both the high voltage and beam current input control signals are analog input voltages in the embodiment described herein, digital inputs including parallel or serial digital bit streams may also be included in an embodiment.

Figure 2A:
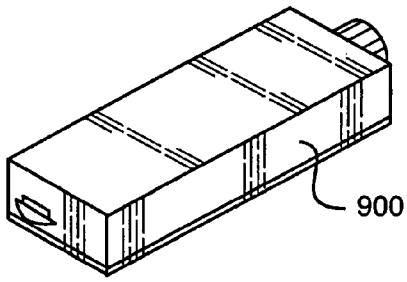
FIGS. 2A-2D are different perspectives of another embodiment according to the system described herein.
Figure 2B:
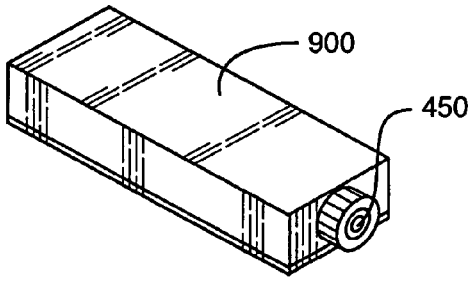
Figure 2C:
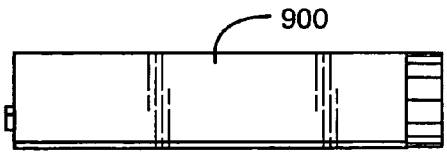
Figure 2D:
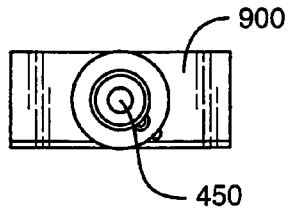
Figure 2E:
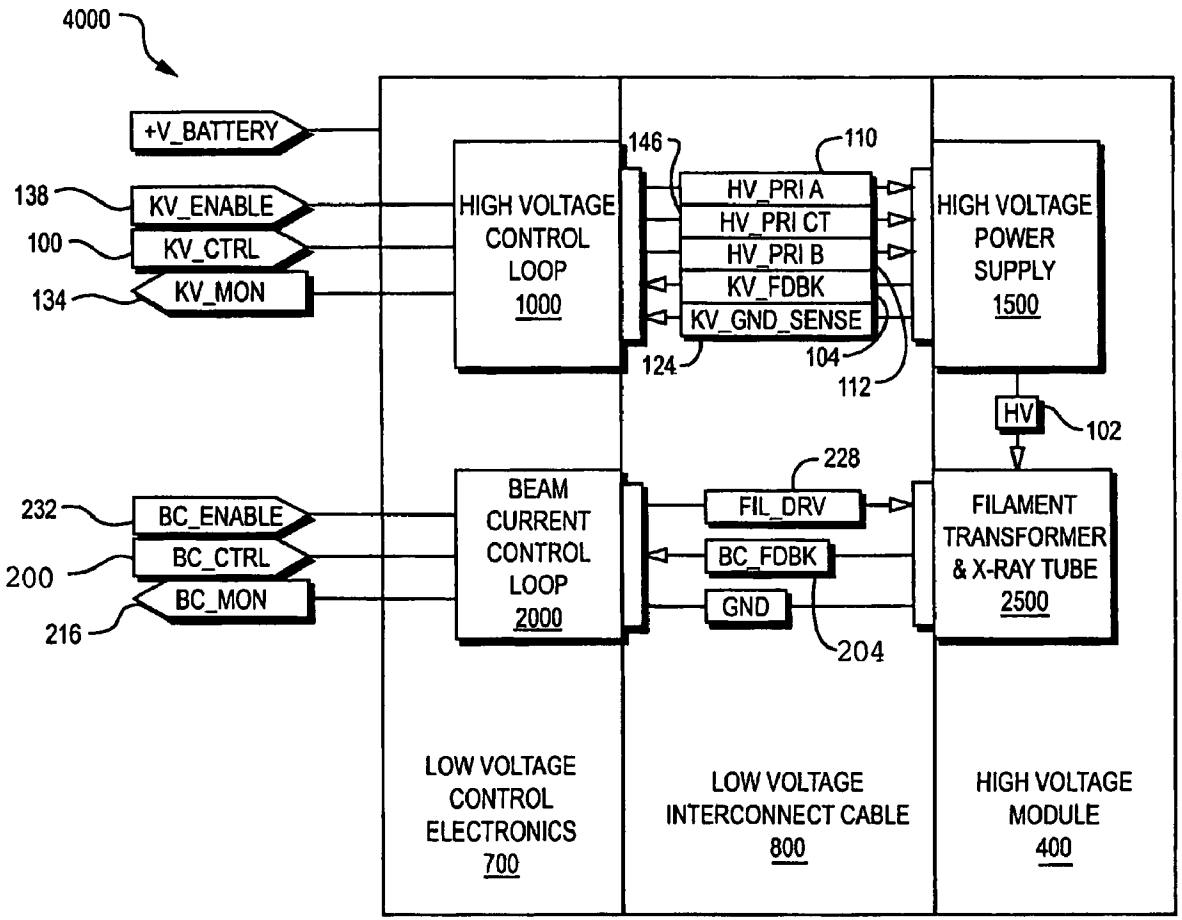
FIG. 2E is an example of an embodiment of an arrangement of components according to the system described herein.

Referring now to FIG. 2E, shown is an example arrangement 4000 of an embodiment of components that may be included in the system 10 of FIG. 1A. The arrangement 4000 includes a first portion of components to physically reside on the PCB 700 and a second portion of the components to physically reside within the module 400. Connections between these two portions of components are maintained by the cable 800. It should be noted that this is one particular physical division of the components and connections therebetween. Other embodiments may designate a different physical division and arrangement of the components described herein. For example, in one embodiment, the components may all reside within the encasing of the module 400 rather than on a separate PCB 700. The particular arrangement may vary in accordance with the particular physical requirements of the device.

In this embodiment, the PCB 700 including the Low Voltage Control Electronics includes a High Voltage Control Loop 1000, and a Beam Current Control Loop 2000. The Module 400 includes a High Voltage Power Supply 1500, and a Filament Transformer and X-Ray Tube 2500.

A power supply, such as a battery, may be included on the PCB 700 to supply power thereto. The signal KV_ENABLE 138 and an input control signal KV_CTRL 100 are inputs to the High Voltage Control Loop 1000 which produces as a system output signal KV_MON 134. This output signal 134 is proportional to the high voltage output and is provided to allow external equipment to monitor the high voltage actually achieved in comparison to the high voltage requested by the KV_CTRL input signal, thereby providing a means for fault detection. Also input to the High Voltage Control Loop 1000 is the KV_FDBK signal 104 and KV_GND_SENSE signal 124. Also produced as output signals from the High Voltage Control Loop 1000 are signals HV_PRI_A 110, HV_PRI_CT 146 and HV_PRI_B 112 which are input to the High Voltage Power Supply 1500. The High Voltage Power Supply 1500 produces as outputs the signals HV 102, KV_FDBK 104 and KV_GND_SENSE 124.

The Beam Current Enable Control Loop 2000 has as inputs the BC ENABLE signal 232, control signal BC_CTRL 200 and BC_FDBK signal 204 and produces as outputs FIL_DRV signal 228 and BC_MON Signal 216, which is proportional to the beam current and is provided as an output from the invention to allow external equipment to monitor the beam current actually achieved in comparison to the current requested by the BC_CTRL input signal, thereby providing a means for fault detection. The Filament Transformer and X-Ray Tube 2500 has input signals FIL_DRV 228 and HV and produces as output signal BC_FDBK 204.

The foregoing signals, components, and the operation thereof, are described in more detail in following paragraphs.

Figure 3A:
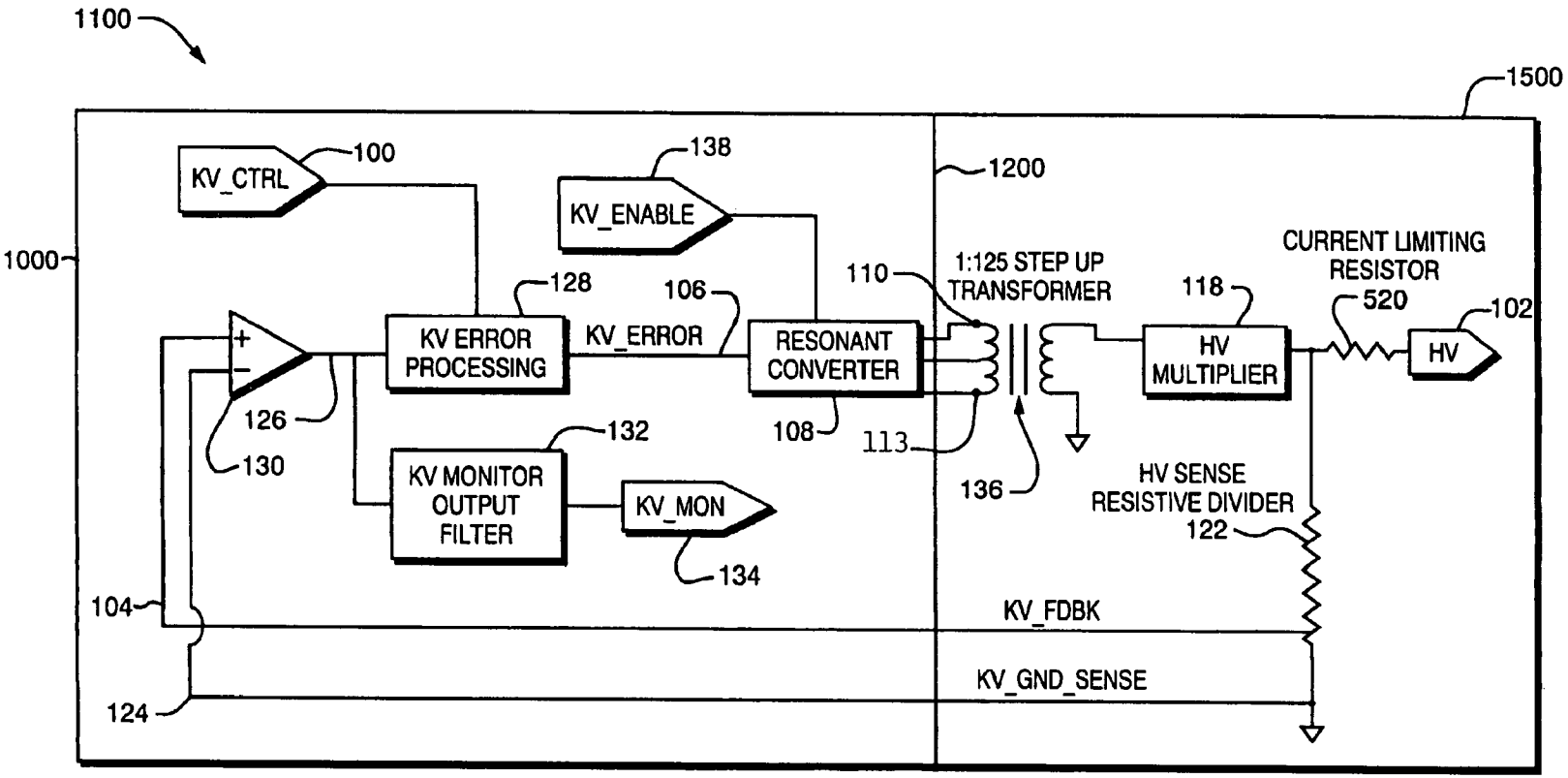
FIG. 3A is an example of a block diagram of an embodiment of a High-Voltage Control Loop and Power Supply according to the system described herein.

FIG. 3A is an example 1100 of an embodiment of components that may be included in the high voltage control loop 1000 and the high voltage power supply 1500. Components within 1000 may be included on the PCB 700 and components included in 1500 may be included within the module 400. The line 1200 represents the physical separation between components in 1000 and 1500 which are connected by the cable 800 as shown in the embodiment of FIGS. 1A and 1B.

Figure 3B:
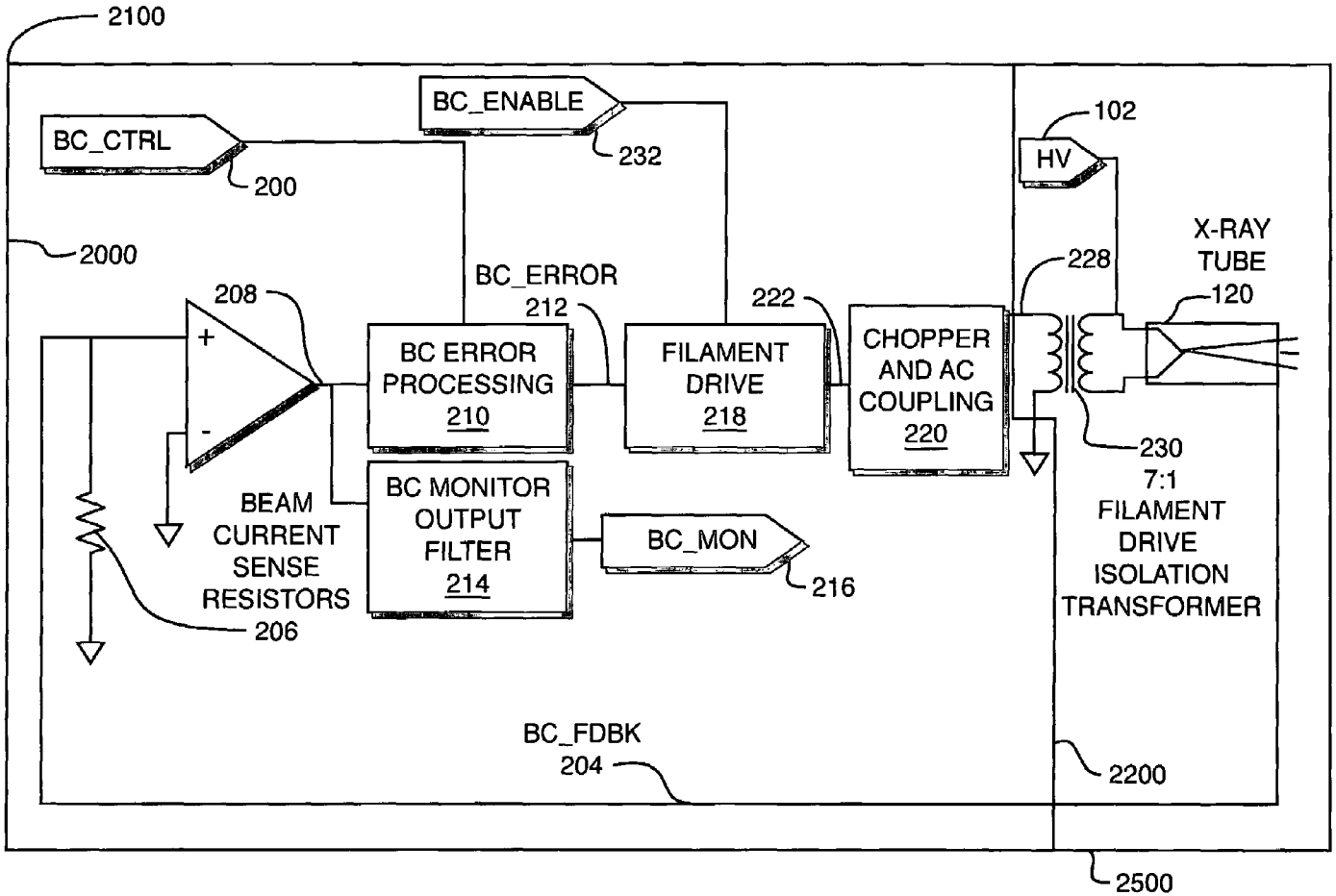
FIG. 3B is an example of a block diagram of an embodiment of a Beam Current Control Loop and Filament Transformer and X-Ray Tube according to the system described herein.

FIG. 3B is an example 2100 of an embodiment of components that may be included in the Beam Current Control Loop 2000 and the Filament Transformer and X-Ray Tube 2500. Components within 2000 may be included on the PCB 700 and components included in 2500 may be included within the module 400. The line 2200 represents the physical separation between components of 2000 and which are connected by the cable 800 to other components in 2500.

Figure 4A:
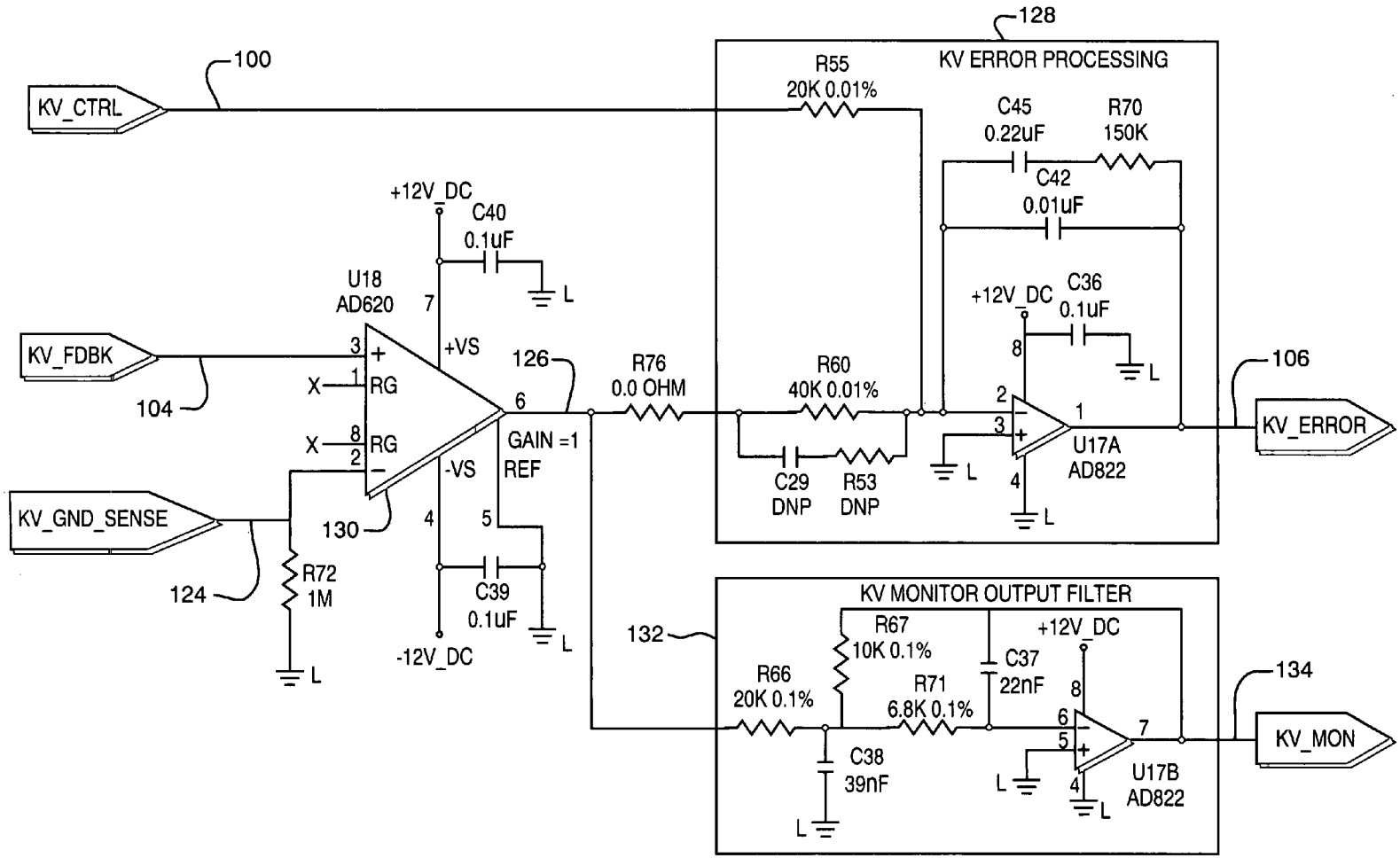
FIG. 4A is an example of a schematic of an embodiment of a KV Error Processing and KV Monitor Output Filter block according to the system described herein.
Figure 4B:
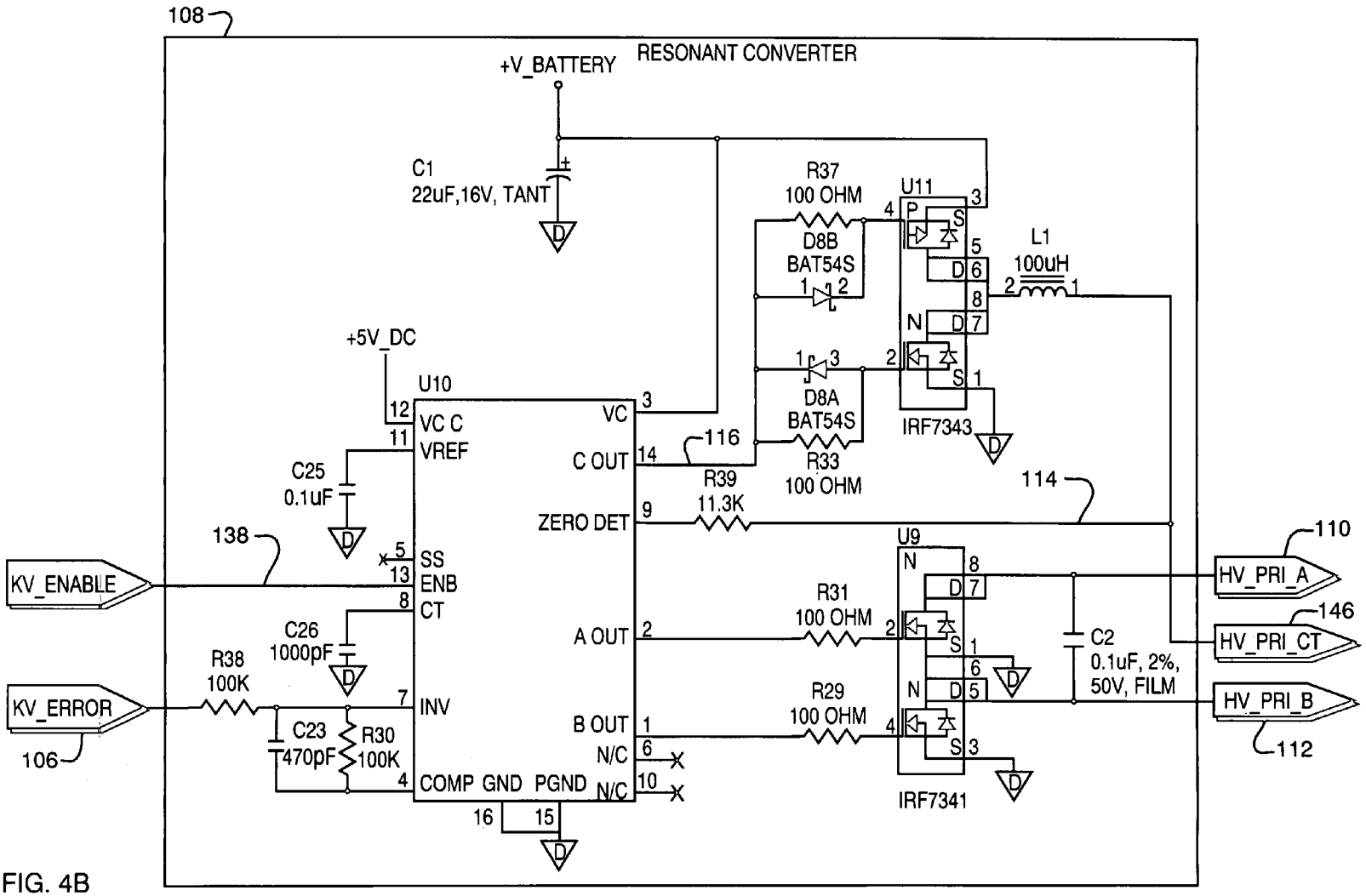
FIG. 4B is an example of a schematic of an embodiment of a Resonant Converter according to the system described herein.
Figure 4C:
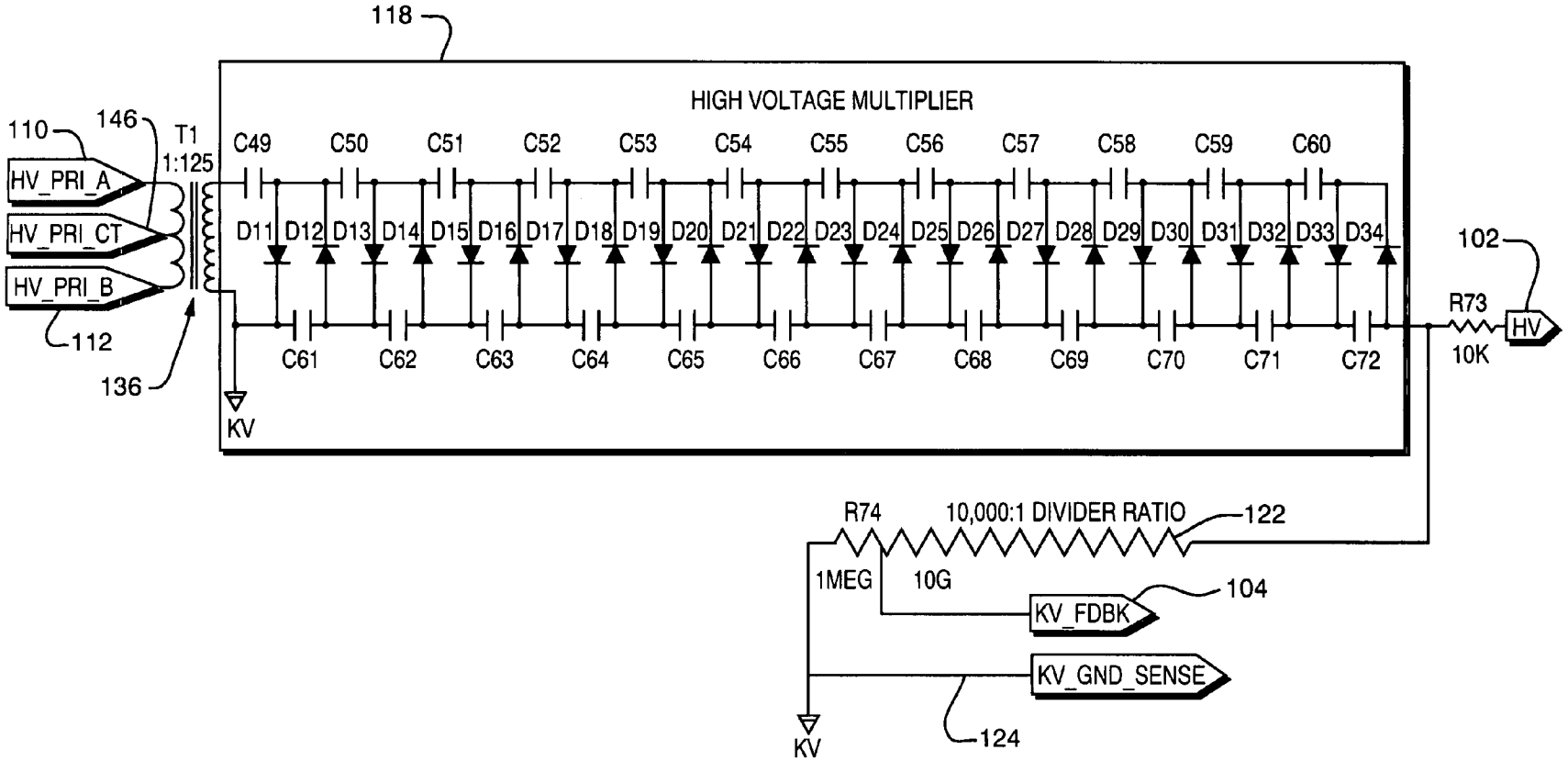
FIG. 4C is an example of a schematic of an embodiment of an HV Multiplier block according to the system described herein.

Referring now to FIGS. 3A, 4A, 4B and 4C, operation of an embodiment 1000 of a High Voltage Control Loop 1000 and Power Supply 1500 is described. FIGS. 4A, 4B and 4C provide more detail of components included in FIG. 3A. In particular, FIG. 4A is an example of a schematic including the KV Error Processing 128 and the KV Monitor Output Filter 132. FIG. 4B is an example of a schematic including the Resonant Converter 108. FIG. 4C is an example of a schematic including the HV Multiplier Block 118.

An input control signal, 100, (KV_CTRL) establishes the desired high voltage output 102. A feedback signal, 104, (KV_FDBK) developed from measurement of the actual high-voltage output 102 by a high resistance voltage divider 122 is applied to the positive input of an instrumentation amplifier 130 at U18-3. A ground sense signal 124 (KV_GND_SENSE) is applied to the negative input of this instrumentation amplifier 130 at U18-2. The purpose of this ground sense signal 124 is to correct 104 for any errors induced due to ground drops which may be present between U18 and 122 which is necessary to provide accurate control of the high voltage output.

Referring now to FIG. 4A, this corrected feedback signal 126 at U18-6 is applied to the input of the KV Error Processing block 128 which includes a proportional-integral-derivative (PID) control function incorporating U17A. This block 128 performs several functions. It first compares the input control signal 100 to the corrected feedback signal 126 and generates an error signal based on the difference in current flowing in resistors R55 and R60. To achieve high accuracy control of the beam current, resistors with extremely tight tolerances and excellent temperature stability may be preferably utilized. The derivative of the feedback signal 126 in this embodiment is developed through C29 and R53. Derivative feedback may be used to improve transient response and reduce control loop overshoot.

In the particular embodiment of FIG. 4A, transient behavior of the system may be acceptable for an intended application or use without a need for including a derivative feedback. Consequently, the particular components and/or connections described herein for use with the derivative feedback are not used in this embodiment described herein and are rather indicated in FIG. 4A with component values of do-not-populate (DNP). However, an embodiment utilizing derivative feedback may also utilize these components in another embodiment. Provisions for the components in the circuit architecture are provided to allow for maximum flexibility in tailoring the control loop response to the specific requirements of particular applications and embodiments. The integral of the error is developed through R70 and C45. Integral feedback is utilized to eliminate any residual DC offset error which may otherwise occur between the requested input value 100 (KV_CTRL) and the actual value as indicated by 104 (KV_FDBK). Scaled versions of the proportional, integral and derivative of this error are developed and combined by the operation of U17A to produce the error signal 106, (KV_ERROR). This PID architecture permits high accuracy, stability and fast transient response of the control loop to be realized. In different embodiments, various combinations of proportional, integral and derivative feedback may be utilized to achieve different control loop response characteristics.

This corrected feedback signal 126 at U18-6 is also applied to the input of the KV Monitor Output Filter block 132. In this embodiment, the purpose of this block 132 is to filter, scale and invert 126 to create the output signal 134 (KV_MON). Other forms of output signal conditioning are also possible. This signal is proportional to the high voltage output and is provided as an output from the system 10 to allow external equipment to monitor the high voltage actually achieved in comparison to the high voltage requested by the KV_CTRL input signal, thereby providing a means for fault detection.

Referring now to FIG. 4B, the error signal 106 is applied to the input of a resonant converter 108. The resonant converter 108 includes components U9, U10, and U11. The resonant converter 108 functions to provide an amplitude modulated sine wave drive to the primary side input of the high voltage step up transformer 136. The inductance of the transformer 136 primary in conjunction with the reflected secondary-side inductance resonate with capacitor C2 and the added capacitance of the transformer 136 reflected secondary-side capacitance. This resonance results in a sinusoidal waveform applied to the transformer primary input terminals 110 and 113. Alternatively switching U9-2 and U9-4 by U10-2 and U10-1 respectively at the resonant frequency provides the means to sustain the oscillation. The oscillation frequency is sensed by 114 and provided as an input at U10-9. Switching occurs during the zero-crossing of the sinusoidal waveform to achieve minimum power loss during the switching transitions.

The amplitude of the sinusoid, and thus the magnitude of the high voltage output 102 is established by the action of the pulse width modulated output signal 116 at U10-14. This signal is applied to the gates of the dual FET array U11, at U11-2 and U11-4. The FET array U11 contains complementary N and P channel FETs which alternately conduct in response to 116. To minimize power consumption during switching and improve power supply efficiency, components R33, R37, D8A and D8B are employed to prevent simultaneous conduction of the N and P channel FETs by combining to provide a slow rising edge and a fast falling edge of the signals applied to the gates of the FETs at U11-4 and U11-2.

The duty cycle of 116 is determined by the magnitude of the error signal 106. The duty cycle determines the average current through L1 and thus the amplitude of the voltage applied to the center tap (HV_PRI_CT) 146 of 136. This center tap voltage in turn establishes the amplitude of the resonant sinusoidal voltage across the 136 primary windings. This resonant converter power supply is enabled by asserting the high voltage enable signal 138 (KV_ENABLE).

Referring now to FIG. 4C, the output of transformer 136 is applied to the input of a diode-capacitor voltage multiplier of a standard Cockroft-Walton configuration 118. The diodes in the multiplier chain are oriented to provide a negative high voltage output relative to electrical ground thereby allowing the X-ray tube 120 to be operated in a grounded anode configuration. Other embodiments are possible whereby the diodes are oriented to provide a positive high voltage output relative to electrical ground. In the grounded anode configuration, the high voltage output of the multiplier is applied to the cathode of the X-ray tube 120 as the accelerating voltage. The high voltage output is also sensed through a high resistance voltage divider 122 to develop the high-voltage feedback signal 104 as discussed above. Control of the high voltage output is provided through adjustment of the input control signal 100. A ground reference signal, 124, (KV_GND_SENSE) is used to monitor and compensate for errors introduced into the feedback signal 104 due to ground drops in any interconnecting cables between the low voltage control electronics and the high voltage power supply.

It should be noted that the combination of resonant converter 108, step up transformer 136 and high voltage multiplier 118 are used to generate the accelerating voltage for an X-ray tube 120. Resonant converters and associated step-up transformers are known in the backlight inverter power supply industry as a power-efficient topology employed in power supply applications intended to power cold cathode fluorescent tubes (CCFL). These CCFL devices are used, for example, as backlights for liquid crystal displays (LCD) in battery operated applications. In those applications, the high voltage achieved from the inverter output is typically no more than a few kilovolts, and can be achieved by the direct output from a step-up transformer such as 136. In the embodiment described herein, the resonant converter and transformer technology is coupled with the high voltage multiplier 118 to achieve a significantly higher output voltage than as used in connection with the conventional power supply applications. As used herein, these components are used in combination in applications to generate a much higher output voltage above the requirements of the intended applications, for example, as may be documented in manufacturers' supporting technical literature.

In the foregoing description, the resonant converter and a transformer are used in combination with a high voltage multiplier chain. The resonant converter and transformer are typically included in, for example, CCFL backlight inverters. The foregoing arrangement combines the resonant converter and transformer with a high voltage multiplier chain to produce an output high voltage that is much larger than that used in the existing CCFL applications. Additionally, use of this CCFL backlight inverter technology, and in particular the stepup transformer as described herein, permits the size of the overall packaging of the high voltage power supply to be significantly reduced. Other existing approaches to creating the high accelerating voltage for the X-ray tube may not result in the tight packaging needed in an embodiment. The foregoing arrangement offers advantages of high voltage power supply that is small in size and has a high power efficiency. These may not be characterized as typical design factors considered in connection with designs of existing X-ray tube technology devices which may use, for example, much larger X-ray tubes and AC-mains-powered power supplies.

Figure 5A:
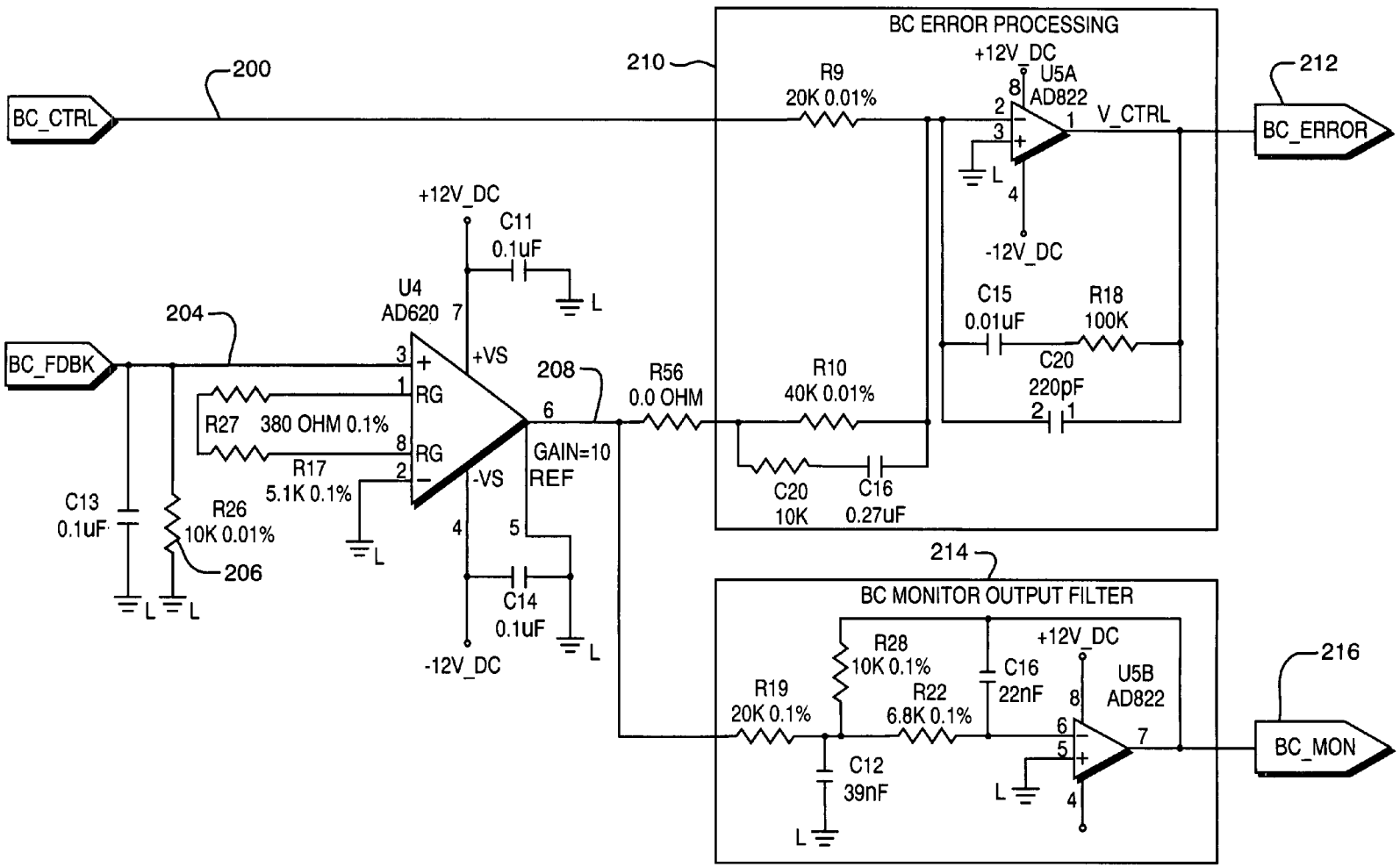
FIG. 5A is an example of a schematic of an embodiment of BC Error Processing and BC Monitor Output Filter blocks according to the system described herein.
Figure 5B:
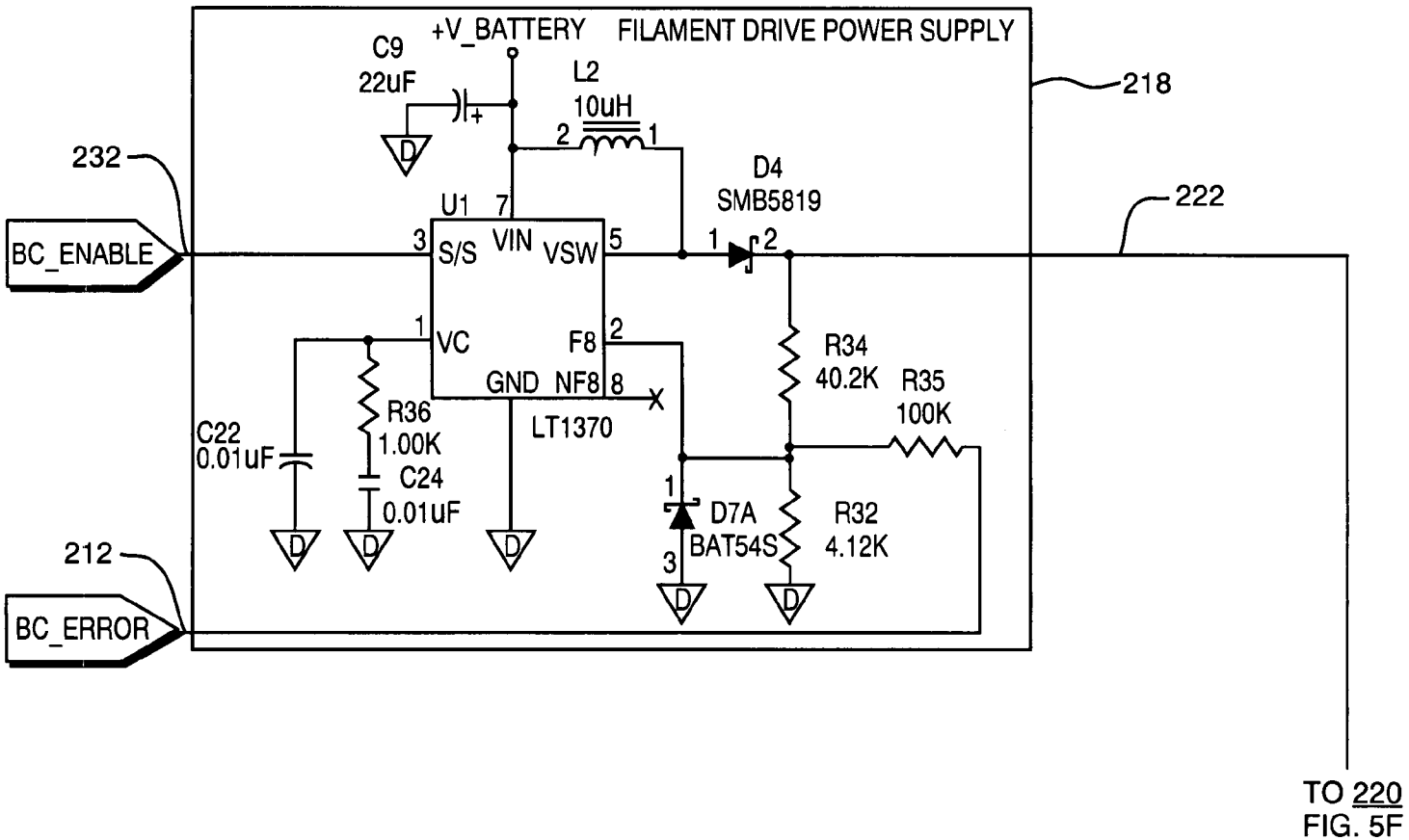
FIG. 5B is an example of a schematic of an embodiment of a Filament Drive block according to the system described herein.
Figure 5C:
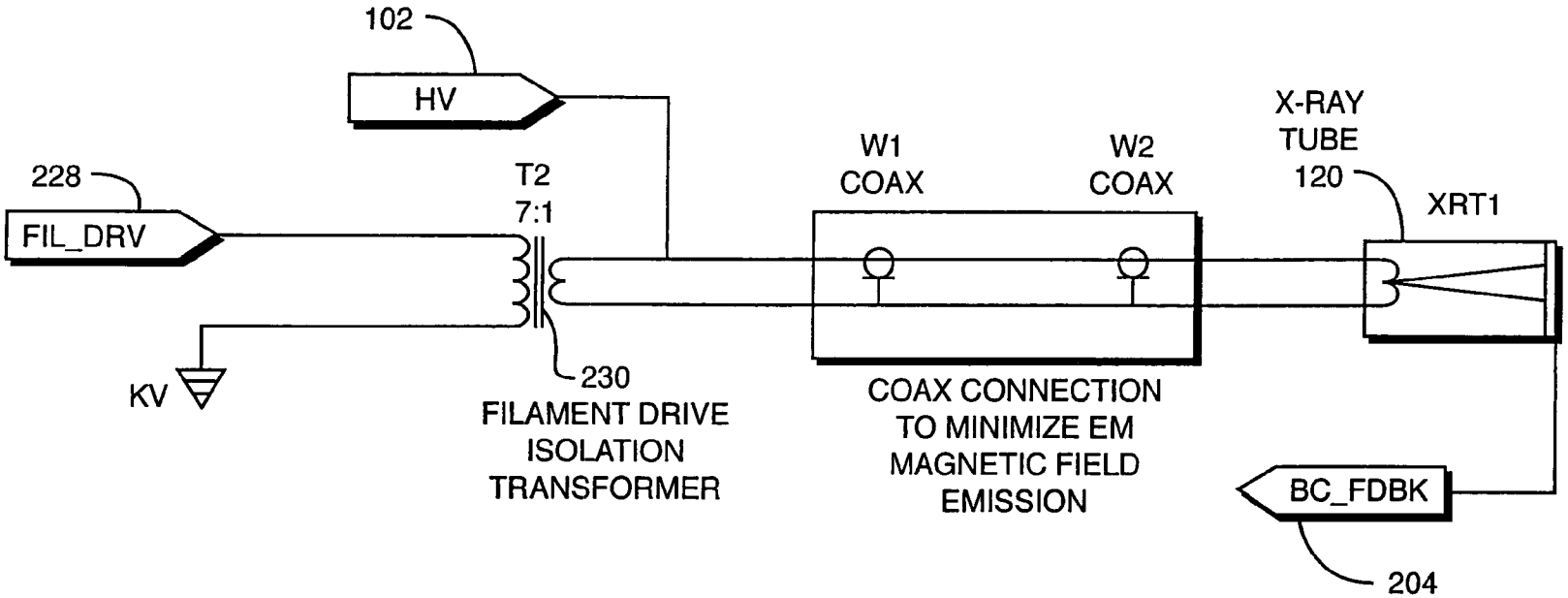
FIG. 5C is an example of a schematic of an embodiment of a Filament Drive Step Down Isolation Transformer and X-ray tube according to the system described herein.

Referring now to FIGS. 3B, 5A, 5B and 5C, operation of an embodiment 2100 of a Beam Current Control Loop 2000 and Filament Transformer and X-Ray Tube 2500 is described. FIGS. 5A, 5B and 5C provide more detail of components included in FIG. 3B. In particular, FIG. 5A is an example of a schematic including the BC Error Processing 210 and BC Monitor Output Filter 214. FIG. 5B is an example of a schematic including the Filament Drive 218 and Chopper and AC Coupling 220. FIG. 5C is an example of a schematic including the Filament Transformer and X-Ray Tube 2500.

In the operation of the Beam Current Control Loop 2000, an input control signal, 200, (BC_CTRL) establishes the desired X-ray tube beam current output. A feedback signal voltage, 204, (BC_FDBK), developed from the beam current by passing it through a beam current sense resistor 206 to ground is applied to the positive input of an instrumentation amplifier at U4-3. To achieve high accuracy control of the beam current, resistor 206 may be preferrably specified with an extremely tight tolerance and excellent temperature stability. In this embodiment, the beam current sense resistor 206 is physically located in close proximity to U4. Consequently, ground sensing and correction is not employed, as there is no significant difference between the ground level at the bottom 206 and the ground reference point at U4-2. In other embodiments, the beam current sense resistor 206 may be located at some distance from U4, possibly in the high voltage power supply or in proximity to the X-ray tube. In these embodiments it may be desirable to employ a similar ground sensing and error correction approach as may be employed for the high voltage circuit 1100. Specifically, U4-2 may be directly connected to the grounded end of 206 instead of local ground.

The conditioned feedback signal 208 at the output from U4-6 is applied to the input of the BC Error Processing block 210 which includes a proportional-integral-derivative (PID) control function incorporating U5A. This block performs several functions. It first compares the input control signal 200 to the conditioned feedback signal 208 and generates an error signal based on the difference in current flowing in resistors R9 and R10. To achieve high accuracy control of the beam current, resistors with extremely tight tolerances and excellent temperature stability are utilized. Scaled versions of the proportional, integral and derivative of this error are developed and combined by the operation of U5A to produce the error signal 212, (BC_ERROR). This PID architecture permits high accuracy, stability and fast transient response of the control loop to be realized. In different embodiments, various combinations of proportional, integral and derivative feedback may be utilized to achieve different control loop response characteristics.

This conditioned feedback signal 208 at U4-6 is also applied to the input of the BC Monitor Output Filter block 214. In this embodiment of the invention, the purpose of this block is to filter, scale and invert 208 to create the output signal 216 (BC_MON). Other forms of output signal conditioning are also possible. Signal 216 is proportional to the beam current and is provided as an output from the invention to allow external equipment to monitor the beam current actually achieved in comparison to the current requested by the BC_CTRL input signal, thereby providing a means for fault detection.

Referring now to FIG. 5B, in this embodiment, the error signal 212 (BC_ERROR) is applied to the input of a filament drive power supply 218 that provides heater current to the filament. In other embodiments, this error signal may be first applied to a linearization stage which takes the fourth root of the error signal to compensate for the approximately $4^{th}$ power dependence of beam current production on filament temperature. Other modifications or scalings of this error signal are also possible in other embodiments.

The filament drive power supply 218 includes an adjustable boost regulator comprised of switching regulator U1 and an output voltage sense resistor network R34 and R32. This network serves to maintain the DC output voltage 222 at a nominal fixed value. Adjustment of this boost regulator is achieved by applying the error signal 212 to the center node of the resistor network through R35. In this manner, current sourced or sunk through R35 by the action of U5A causes U1 to adjust output voltage 222 to compensate. This power supply is enabled by asserting the beam current enable signal 232 (BC_ENABLE).

DC output signal 222 is applied to the input of a chopper and AC coupling block 220 which converts this adjustable DC signal into an AC waveform. The chopper includes U16, U15 and U7. U16 is a fixed frequency oscillator which produces a nominal 50% duty cycle square wave output 224, which is then applied to U15, a MOSFET driver. The outputs U15-6 and U15-7 drive the gates of dual FET array U7, containing complementary N and P channel FETs. The FETs alternately conduct, thereby chopping the DC input voltage 222 at U7-3 and provide a chopped DC output 226 at U7-5, 6, 7, 8. To minimize power consumption during switching and improve power supply efficiency, components R11, R13, D6A and D6B are employed to prevent simultaneous conduction of the N and P channel FETs by combining to provide a slow rising edge and a fast falling edge of the signals applied to the gates of the FETs at U7-4 and U7-2.

The chopped DC signal 226 is applied to AC coupling capacitor C3 to remove the DC component and create an AC waveform as signal 228 (FIL_DRV), which is used to drive the primary side of the filament drive isolation transformer 230 as shown in FIG. 5C. The secondary side of this transformer 230 is connected to the filament within the X-ray tube 120 at the cathode end. A connection between this transformer secondary and the output from the high voltage power supply 102 is also established to raise the filament to the accelerating voltage potential. A high degree of voltage isolation is provided across the primary and secondary windings of 230 to prevent voltage breakdown during operation.

Beam current is produced by increasing the value of the input control voltage 200 (BC_CTRL) from zero volts. This has the effect of raising the output voltage of the filament power supply 222 from a minimum value to a value sufficient to heat the filament adequately to create thermionic emission. The minimum output voltage of 222 is set to prevent the filament from achieving adequate temperature to initiate emission but is sufficient to raise the filament temperature to an intermediate value to warm it up. In this manner, a short filament turn-on response time is achieved when beam current is requested by avoiding the time associated with heating the filament up from a cold condition.

Figure 5D:
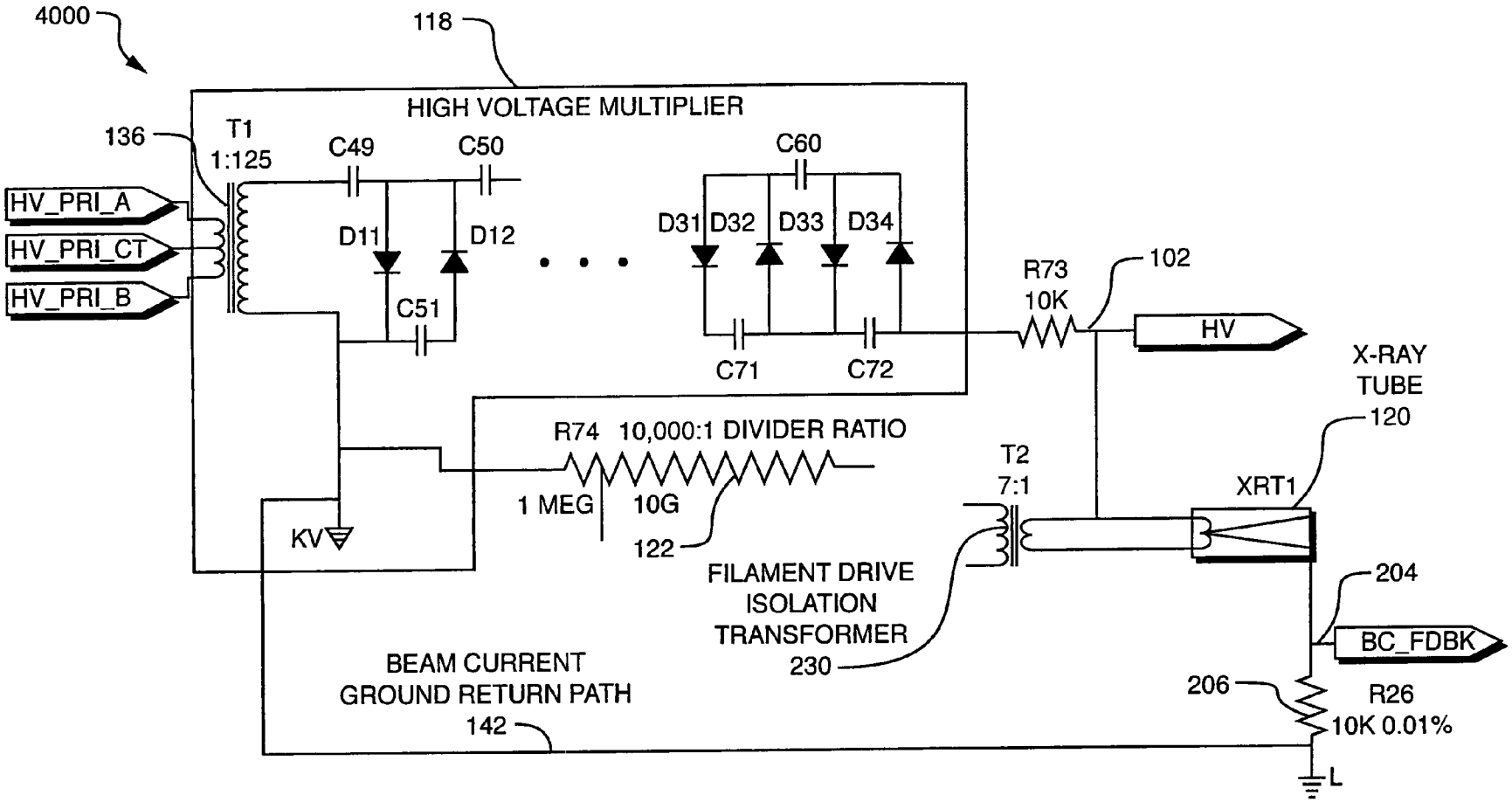
FIG. 5D is an example of an embodiment of components used for beam current sensing.

Referring now to FIG. 5D, shown is an example of a configuration 4000 that may included in an embodiment to perform beam current sensing. The beam current feedback signal 204(BC_FDBK) is developed as follows: Beam current flows through the high voltage multiplier chain 118 and into the X-ray tube 120 filament where it is summed in with the filament heater current from the filament drive isolation transformer 230. Electrons thermionically emitted from the heated filament constitute the beam current that then flows from the cathode (filament) of the X-ray tube to its anode (target and window). A precision beam current sense resistor 206 connects the anode to ground. The current flows through resistor 206 and back into the high voltage multiplier chain 118 via the ground return path 142 to complete the circuit. The beam current feedback signal voltage 204 (BC_FDBK) is generated by sensing the voltage at the anode end of the beam current sense resistor 206. Only millivolts of signal need be generated, so that the X-ray tube anode is maintained, essentially, at ground potential.

It should be noted that FIG. 5D includes components from the various components and connections therebetween as described previously herein, for example, in FIGS. 3A and 3B. The particular components included in FIG. 5D are selected for purposes of illustrating and explaining operation and development of the beam current feedback signal 204 (BC_FDBK).

An embodiment may also include other variations with respect to producing the beam current feedback signal 204 (BC_FDBK). FIG. 5D illustrates an arrangement in which beam current sensing is performed at the X-Ray tube anode based on the electron beam current flowing to ground through the beam current sense resistor 206. What will now be described is another alternate arrangement that may be used in connection with producing the beam current feedback signal 204(BC_FDBK) which, in contrast to the arrangement of FIG. 5D, performs beam current sensing based at the high voltage multiplier 118 ground.

Figure 5E:
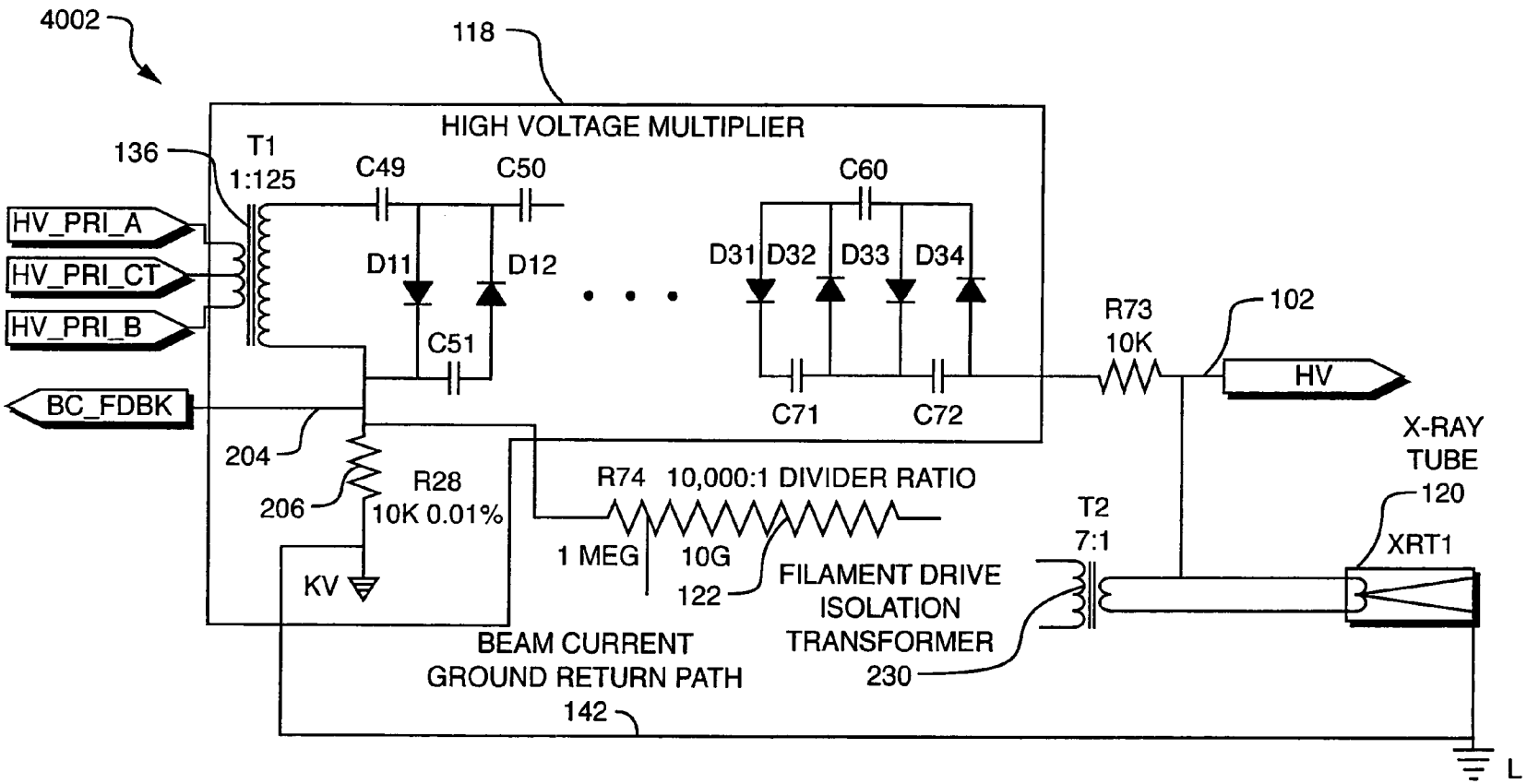
FIG. 5E is an example of another embodiment of components used for beam current sensing.
Figure 5F:
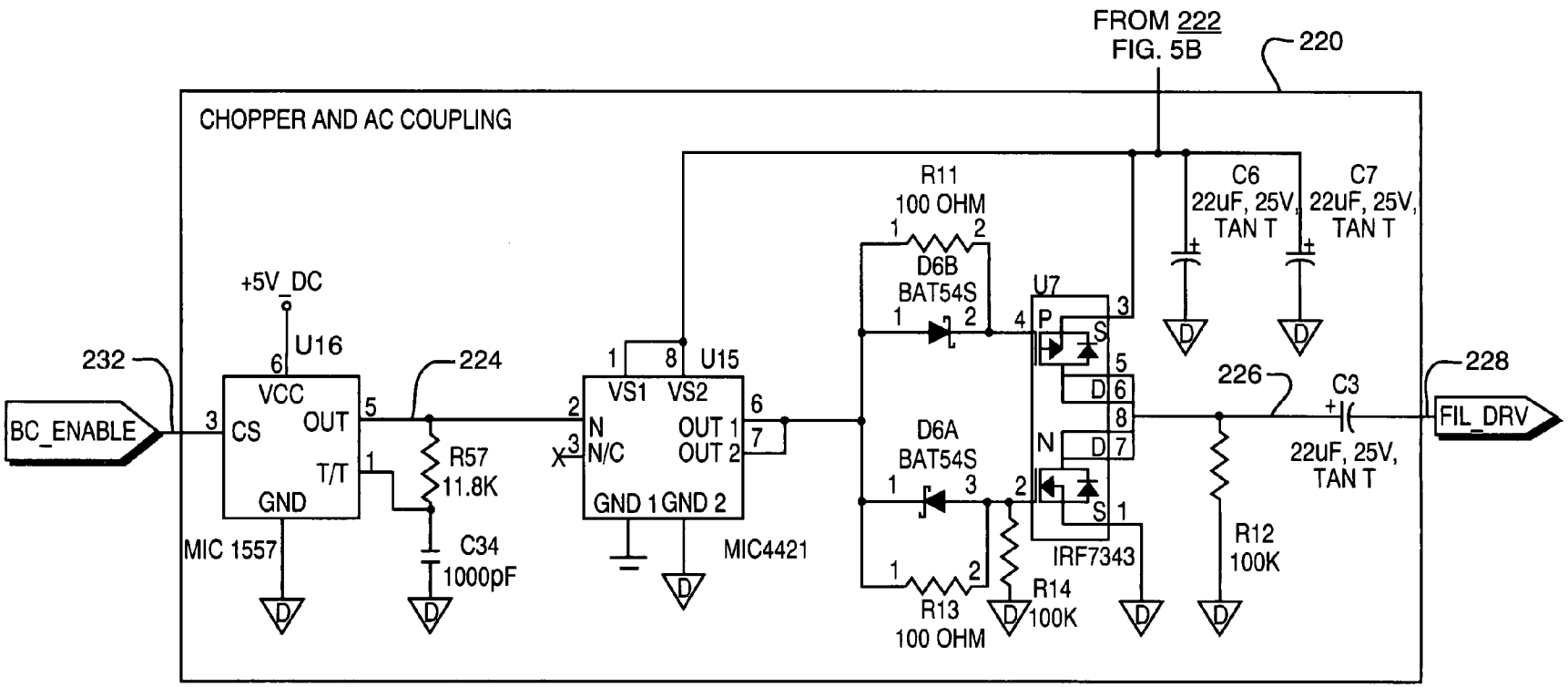
FIG. 5F is an example of an embodiment of components used for a chopper and AC coupling.

Referring now to FIG. 5E, shown is an example of a configuration 4002 that may included in an embodiment to perform beam current sensing. In this configuration 4002, the X-ray tube 120 anode may be tied directly to ground with the beam current sensed as the return current back into the high voltage multiplier. The beam current sense resistor 206 is placed in series with the ground connection to the high voltage multiplier chain 118. Beam current flowing from the X-ray tube 120 anode through the ground return path and back into the high voltage multiplier chain 118 as a return current develops a voltage across this beam current sense resistor 206 which is subsequently utilized as the beam current feedback voltage.

In the configuration 4002, the high voltage sense resistive divider 122 is connected to the top of 206 as shown, rather than being connected directly to ground (as in FIG. 5E), which causes all of the returning beam current to flow through 206. In this manner an accurate measure of beam current can be made. The polarity of 204 (BC_FDBK) is inverted from the polarity of the voltage which results from the configuration in FIG. 5E. Consequently, when using the configuration 4002 of FIG. 5E, the connections at the inputs of U4-2 and U4-3 (FIG. 5A) are reversed for proper operation. For accurate measurement of high voltage, the differential voltage across the bottom part of the high voltage divider 122 is measured. This can be accomplished at instrumentation amplifier 130 (FIG. 4A) by connecting instrumentation amplifier 130 pin U18-2 directly to 204 (BC_FDBK) thereby breaking the connection to 124 (KV_GND_SENSE). In this manner, the voltage drop across 206 is subtracted from 104 (KV_FDBK) to create the corrected feedback signal 126 at U18-6.

It should be noted that in the foregoing, the low voltage control electronics may be powered by a variable DC source input voltage. The variability may be within a specified range to supply a predetermined voltage in accordance with an embodiment irrespective of the variable source input. In one embodiment, the system may operate in a range of +4 volts to +10 volts although other embodiments may use other ranges. An embodiment may also fix the DC source input voltage. As described herein, a battery may be used as a part of the power supply. However, an embodiment may also include other power sources, for example, using a DC source plugged into a wall plug or outlet.

The foregoing description provides a low power, high efficiency, electrically shielded and radiation-shielded X-ray module that may include an X-ray source, high voltage power supply and high accuracy control electronics and that can be configured into complex geometries for use in field-portable X-ray instruments used in a wide variety of applications. The compact X-ray module may be utilized in devices applications where space is restricted. The lightweight X-ray module may be included in, for example, hand-held, portable instruments. The X-ray module may be powered by a small low-voltage battery with an unregulated output, and provide the advantage of being highly power efficient, for low power applications. In the radiation-shielded X-ray module described herein, the weight of the radiation shielding is minimized in accordance with the requirements for use in a hand-held instrument.

The foregoing description also provides a highly power efficient drive circuit for a compact X-ray unit. The X-ray module is capable of controlling the X-ray output to a high degree of accuracy, precision and stability. The foregoing X-ray module includes a highly flexible and adaptable internal architecture that can interface with X-ray tubes from different suppliers. The X-ray module described herein may include a miniature, low-power X-ray tube and high voltage power supply encapsulated in a rigid, free standing, electrically insulating material. The encapsulation material may surround any or all portions of the X-ray tube, high voltage power supply and control electronics, with the exception of the X-ray output window of the X-ray tube, which is left exposed. A thin layer of conductive material adherent to the outer surface of the rigid encapsulating material provides a grounded conducting surface to shield electric fields from the module. By eliminating the need for an external grounded housing, the dimensions of the X-ray module described herein may be minimized. Additionally, the mechanical rigidity of the X-ray module may be provided by the rigid encapsulating material so that the module may be easily and economically configured in a wide range of complex geometries.

The electrically-insulating encapsulation material described herein may contain a radio-opaque material, that may be conductive or non-conductive, that shields X-rays emanating from the unit. It should also be noted that it may be preferred that the combination of the radio-opaque material included with the encapsulation material have a high dielectric strength approximately close to the dielectric strength of the encapsulation material. By incorporating the radio-opaque material into the electrically-insulating encapsulating material, the radio-opaque material is brought into close proximity to the X-ray tube, thereby providing maximum shielding for minimum added weight. As described herein, the formulation of the combined radio-opaque and encapsulating material may be chosen so as to retain the high dielectric strength of the encapsulating material. Thus, the radio-opaque encapsulating material can be brought into close contact with all parts of the X-ray tube, further maximizing the shielding effectiveness. Additionally, by retaining the high dielectric strength of the encapsulating material, the high voltage insulating thickness and the overall dimensions of the module remain substantially unchanged.

The foregoing description provides for efficient delivery of electrical power to the high voltage power supply of the high voltage module. It may be preferred to drive a high voltage DC power supply at the highest possible frequency in order to obtain the best possible voltage regulation. At sufficiently high frequencies, the stray capacitance to ground of the high voltage power supply becomes the dominant load. In order to achieve the advantage of a very compact module size, the foregoing includes a module surrounded by the smallest possible thickness of high dielectric strength material which is then coated with a conducting material to provide a ground plane. The design of the foregoing includes an increase in the stray capacitance to ground of the high voltage power supply relative to a design in which the ground plane is located at a larger average distance from the components of the high voltage supply. In order to provide the highest possible power efficiency, the high voltage power supply may be driven by a resonant converter circuit. It will be appreciated that the small size of the encapsulated high voltage module and the resonant converter of the low voltage drive circuit work together in the foregoing arrangement to provide a maximally compact and power efficient X-ray source for use in field-portable, battery operated X-ray instruments.

The foregoing also utilizes amplitude-modulation techniques in the resonant converter circuit and filament drive circuit to provide for high voltage and beam current output adjustment. Use of these techniques also provides an advantage of a power-efficient design.

The foregoing also provides for control electronics designed to operate over a wide range in input voltage such as may be obtained from a battery power source. This may be characterized as an important consideration for battery-operated instrumentation, in which the battery voltage may be directly applied to the circuits. By operating directly from the battery, this circuit does not require pre-regulation of the battery voltage, thereby reducing circuit complexity and allowing for a more compact design, and avoiding power losses associated with this pre-regulation stage, resulting in a more power-efficient design.

An additional aspect of the foregoing is that the electronics design architecture offers flexible configurability, thereby allowing the low voltage control circuits to be directly coupled to, and optionally encapsulated with the X-ray tube and high voltage power supply assembly, or connected to a separately encapsulated X-ray tube and high voltage power supply assembly via a thin, flexible, low voltage interconnect cable. This packaging flexibility allows for configurations of a large variety of spatial geometries as dictated by available space and packaging requirements.

A more detailed aspect set forth herein provides an advantage of flexibility in the electronics design to allow the use of X-ray tubes from different commercial vendors. The control system architecture is such that one design implementation may be utilized with different X-ray tubes within a defined range of specification.

Use of the techniques described herein provides for a self-contained, very small, lightweight power-efficient X-ray source module, especially suitable for hand held, battery operated, portable instruments used in on-site inspection and analyses. One use of the instruments employing the techniques herein is materials analysis instrumentation based on X-ray fluorescence spectroscopy, whereby the instruments employing the techniques described herein may replace the radioactive isotope commonly used as the X-ray source. Furthermore, utilizing the techniques described herein allows for the integration of an X-ray tube and associated high voltage electronics in a single, electrically-shielded and radiation-shielded unit that is lightweight, compact and safe enough to be operated in a handheld X-ray instrument. Further, power efficient control electronics may be used allowing the unit to operate from a standard, low-power battery. As also described herein, the foregoing techniques may be employed in devices configured into complex geometries in accordance with the spatial requirements of specific instruments.

While the invention has been disclosed in connection with various embodiments, modifications thereon will be readily apparent to those skilled in the art. Accordingly, the spirit and scope of the invention is set forth in the following claims.

What is claimed is:

1. A radiation-shielded X-ray module comprising:

an X-ray tube that emits X-rays;

a high voltage power supply coupled to said X-ray tube that supplies a high voltage for use with said X-ray tube; and electrical connection that connects the X-ray tube to the high voltage power supply, wherein the X-ray tube and the high voltage power supply are encapsulated in a solid, electrically-insulating encapsulant containing a radio-opaque material distributed within the encapsulant, the encapsulant being in direct contact with substantially the entire X-ray tube and the high voltage power supply, the encapsulant being substantially free from entrained air, said radio-opaque material including a material selected from the group consisting of tungsten, lead, calcium, tantalum, tin, molybdenum, copper, strontium, aluminum, bismuth and compounds and mixtures containing any of the above materials.

2. The radiation-shielded X-ray module of claim 1, further comprising:

a resonant converter that drives said high voltage power supply via an amplitude modulated waveform drive at a substantially resonant frequency.

3. The radiation-shielded X-ray module of claim 2, further comprising:

a step up transformer connected to said resonant converter; and a high-voltage multiplier driven by said step up transformer.

4. The radiation-shielded X-ray module of claim 2, wherein the amplitude modulated waveform drive responds to a sensed resonant frequency.

5. The radiation-shielded X-ray module of claim 1, wherein an amount of said radio-opaque material is selected in accordance with a predetermined degree of radiation attenuation.

6. The radiation-shielded X-ray module of claim 1, further comprising:

a thin conductive layer over said solid, electrically insulating encapsulant to provide electric shielding.

7. The radiation-shielded X-ray module of claim 6, wherein said thin conductive layer is formed from one of: a conductive metallic paint, a thin metal foil, and a metallized polymer.

8. The radiation-shielded X-ray module of claim 7, wherein said thin conductive layer is formed from a thin metal foil made from at least one of: copper and aluminum.

9. The radiation-shielded X-ray module of claim 8, wherein said thin metal foil is adhered directly to said solid, electrically insulating encapsulant using an adhesive.

10. The radiation-shielded X-ray module of claim 1, wherein the solid, electrically-insulating encapsulant is molded into a complex shape.

11. The radiation-shielded X-ray module of claim 1, wherein the X-ray tube and the high-voltage power supply are connected by a coaxial cable.

12. The radiation-shielded X-ray module of claim 1, wherein the radiation-shielded X-ray module is included in a portable X-ray instrument.

13. The radiation-shielded X-ray module of claim 1, wherein the radio-opaque material comprises an oxide of tungsten, lead, or bismuth.

* * * * *